US009994354B2

(12) United States Patent
Volpis

(10) Patent No.: US 9,994,354 B2
(45) Date of Patent: Jun. 12, 2018

(54) VENTILATED PIZZA BOX

(71) Applicant: Paolo Volpis, Beverly Hills, CA (US)

(72) Inventor: Paolo Volpis, Beverly Hills, CA (US)

( * ) Notice: Subject to any disclaimer, the term of this patent is extended or adjusted under 35 U.S.C. 154(b) by 3 days.

(21) Appl. No.: 15/426,817

(22) Filed: Feb. 7, 2017

(65) Prior Publication Data

US 2017/0233129 A1 Aug. 17, 2017

Related U.S. Application Data

(60) Provisional application No. 62/386,605, filed on Dec. 7, 2015.

(51) Int. Cl.

| | |
|---|---|
| ***B65D 5/42*** | (2006.01) |
| ***B65D 5/48*** | (2006.01) |
| ***B65D 85/36*** | (2006.01) |
| ***B65D 5/20*** | (2006.01) |
| ***B65D 5/66*** | (2006.01) |

(52) U.S. Cl.
CPC ..... *B65D 5/4295* (2013.01); *B65D 85/36* (2013.01); *B65D 2585/366* (2013.01)

(58) Field of Classification Search
CPC ..... B65D 5/4295; B65D 5/2052; B65D 5/48014; B65D 5/6658; B65D 85/36; B65D 2585/366; B65D 2205/02; B65D 2581/3406; B65D 81/263
USPC ..... 229/120, 902, 903, 904, 906, 120.21, 229/122.34
See application file for complete search history.

(56) References Cited

U.S. PATENT DOCUMENTS

| | | | | |
|---|---|---|---|---|
| 4,498,420 | A * | 2/1985 | Botterman | A01K 67/033 119/6.5 |
| 4,836,383 | A * | 6/1989 | Gordon | B65D 5/48014 219/730 |
| 5,385,292 | A | 1/1995 | Labianca et al. | |
| 5,423,477 | A | 6/1995 | Valdman | |
| 6,386,440 | B1 * | 5/2002 | Tulkoff | B65D 5/48024 229/120.06 |
| 7,210,613 | B2 | 5/2007 | Lethrer | |
| 7,261,231 | B2 | 8/2007 | Kuhn | |
| 8,662,378 | B2 * | 3/2014 | Mehta | B65D 5/4295 229/103.11 |
| 8,770,466 | B1 | 7/2014 | Trlesky | |

* cited by examiner

*Primary Examiner* — Christopher Demeree
(74) *Attorney, Agent, or Firm* — Brentwood IP Law, p.c.

(57) ABSTRACT

A multicompartment ventilated box is shaped by folding and attaching one or more blanks of a material. One or more attachment portions enable forming at least one compartment. The box may comprise an upper and a lower compartment and perforations that permit air flow between the compartments and to the exterior of the box. The compartments may be separated by a tray portion which transitions between an elevated and a collapsed position.

21 Claims, 30 Drawing Sheets

VENTILATED PIZZA BOX

TECHNICAL FIELD

This disclosure generally relates to food containers and specifically to pizza boxes.

BACKGROUND

One of the biggest problems with pizza delivery or carry out boxes is that during transport the pizza crust loses crispness and becomes soggy. This obviously reduces the quality of the product which is no longer as good as if it was fresh out of the oven. In particular, the taste, bite, texture, and overall perception of the product are often compromised. The pizza chef may also become frustrated because the diminished quality of the product at the time of consumption does not represent the chef's level of skill and potential cutting edge talent.

The following factors are believed to at least partially contribute to this issue. First, the steam released from the hot and watery ingredients is essentially confined inside the closed box and absorbs back into the crust making it soggy. Such an issue may be further exacerbated when the box is transported in delivery bags which allow for little or no ventilation. Allowing quick release of almost all of the steam from a pizza is not a favorable solution because the heat would escape together with the steam, resulting in a cold product. For most customers and restaurants, this is not a positive compromise. On the other hand, allowing the steam and heat to escape from the box too slowly in order to retain some heat inside may provide warm or even hot pizza, but it will likely still become soggy.

Second, when the pizza is cut prior to delivery (as is common in the industry), liquids such as oils and juices can escape the pizza to collect at the bottom of the box. In such a scenario, the pizza is essentially sitting on a wet surface. Consequently, the crust ends up absorbing the liquids like a sponge which again renders it soggy.

To date, attempts to address the issue of soggy pizza crusts have been largely unsatisfactory. For instance the interior of a box may be lined with a heat reflective material such as foil. The idea here is to allow steam to escape quickly and relying on the heat reflective or retaining inner surface to maintain heat in the box. However, this technique has limitations. For instance, the liquids from the pizza can still pool below the crust and reabsorb into the pizza. Also, the additional reflective material and production steps required may drastically increase the cost. Most pizza producers have a sensitive profit margin and therefore are not likely to view this as a viable solution.

Yet another attempt involves a pizza box design with ventilated top and bottom surfaces. For example, one design includes staggered cutouts across three layers of the cardboard material to allow air and steam to pass through the center corrugated layer to reach the exterior of the box. Several problems exist here. When multiple boxes are stacked, the path of heat or steam released through the top of a box can obstructed by the box above it. As yet another issue, the steam that escapes from the top may flow into the box directly above it thereby contributing to the very issue the design seeks to avoid. Finally, the liquids dripping to the bottom of the box can pass right through the ventilated bottom and into the box below it. To make matters worse, the box can stain any surface it sits on because the liquids diffuse from the bottom. Of course, placing grease proof paper at the bottom of the box defeats the purpose of a ventilated bottom as it prevents steam from exiting the bottom.

Elongated pores in the shape of stripes on the bottom of the box have also been suggested. Such a design is likely to suffer from uneven ventilation since the pores are not uniformly laid out. Similar to other suggested designs, the ventilation here may also be obstructed when such boxes are stacked or lined with grease paper. Additionally, these boxes may also leak the liquids, particularly when housing cut pizza.

The above solutions appear even less viable when considering common industry and customer practices. For instance, pizza boxes are often delivered using a pizza bag which provides little or no ventilation. As such, during delivery a box, or stack of boxes, may be maintained for as long as 30 minutes in a moisture rich environment that can exacerbate the problem with soggy crusts. Customer carry out is also problematic because the box would have to be held up during transport to allow ventilation from the bottom. In other words, unless a single box is held up during the entire time between purchase and consumption, it will invariably rest on another surface during transport for a significant period of time. Again this frustrates ventilation from the bottom of the box.

To date, attempts at addressing the problems discussed above have been unsatisfactory. Many of the designs provide little or no improvement. Moreover, some also require special circumstances in order to provide proper venting or to prevent leaking.

SUMMARY

The present embodiments introduce multicompartment ventilated boxes for storing and transporting food items such as pizza. In particular, a ventilation system is provided where air flow can circulate under the pizza crust. In such a system, the box can release excess steam without substantial heat loss inside the box. Accordingly, quality of the pizza is maintained for a prolonged period of time and the quality resembles that of a pizza fresh out of the oven. The flexibility of this design allows it to accommodate small and large food items and work in any practical scenario for any user.

In the exemplary embodiments, the box is shaped by folding and attaching one or more blanks of a material. The box may comprise attachment portions to enable forming at least one compartment, and comprise perforations that permit flow between the compartments and to the exterior of the box. For instance, the box can comprise an upper compartment and a lower compartment separated by a tray portion which transitions between an elevated and a collapsed position. The box can be configured to allow steam in the upper compartment to diffuse through the tray perforations into the lower compartment and then to the exterior of the box.

In an exemplary embodiment, a ventilated box for storing and transporting pizza comprises a top panel, a bottom panel, a front wall, a rear wall and opposing sidewalls. The front and rear walls are foldably connected to opposing sides of the bottom panel. The rear wall comprises a tray attachment receiving portion and is foldably connected to the top panel. A tray is foldably connected to the front wall on one end of said tray and comprises a tray attachment portion at the opposite end. When the tray attachment portion is attached to the rear wall the lower compartment is formed.

This compartment may be defined by the space between the tray, the front wall, the rear wall, the bottom panel and the side walls. Above it, the upper compartment may be defined by at least the space between the tray, the front wall, the rear wall and the side walls. In accordance with this exemplary embodiment, the top panel may be folded over to close the box. Moreover, closing the box can urge the rear wall toward the front wall thereby elevating the tray away from the bottom panel. The tray and at least one side wall, rear wall or front wall may be perforated to ventilate steam in the upper compartment through the bottom compartment and to the exterior of the box.

In accordance with another exemplary embodiment, a ventilated box comprises an outer box portion and a tray portion. The outer box portion comprises a top panel and a bottom panel which comprises a front tray attachment receiving portion. A front wall and a rear wall are foldably connected to opposing sides of the bottom panel, where the rear wall comprises a rear tray attachment receiving portion and is foldably connected to the top panel. Additionally, a pair of sidewalls foldably connect to opposing sides of the bottom panel. The tray portion comprises a front and rear attachment portions. The front attachment portion connects to the bottom panel and the rear attachment portion connects to the rear wall thereby forming the lower compartment. Here too, the rear wall may be urged toward the front wall thereby elevating the tray away from the bottom panel. The tray and at least one side wall, rear wall or front wall may be perforated to ventilate steam in the upper compartment through the bottom compartment and to the exterior of the box.

DETAILED DESCRIPTION OF THE EMBODIMENTS

The following detailed description is merely exemplary in nature and is not intended to limit the scope or application of the embodiments. In particular, the ventilated boxes are described with respect to pizza storage and transport for illustrative purposes and are not necessarily limited to such application. The present disclosure contemplates application of the ventilated boxes for essentially any food item that is suitable for, or that may benefit from, the features described. Additionally, discussions of the ventilation system or mechanical action of the box are provided without being bound to any particular theory. Furthermore, any implementation described as "exemplary", "illustrative" or a variation thereof, is not necessarily intended as preferred or advantageous over other implementations and is not intended to limit the disclosure. The numbering of the figures is not necessarily indicative of the order of construction or manipulation of the box. Dashed lines are provided to show the folding line between two portions adjacent to the fold.

In accordance with an exemplary embodiment, FIGS. 1-12 illustrate a ventilated box at various stages of folding and attachment. In this example, the box is formed from a single integral blank of material. However, in some instances, it may be possible to form such a cutout by joining two or more separate blanks of material. The material for the box 10 can comprise cardboard, or any other material with similar properties or suitable for use with food items.

Figure 1:
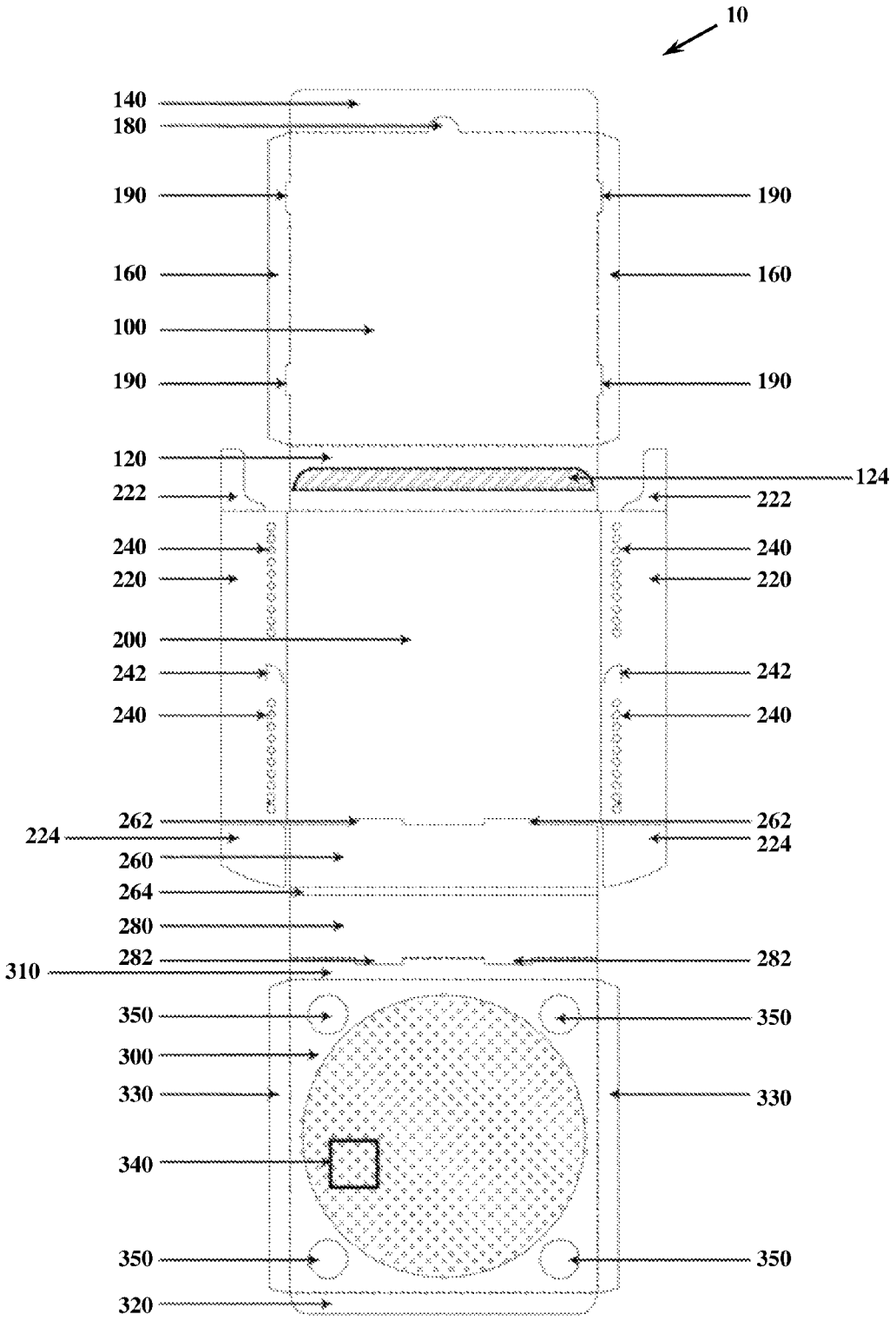
FIG. 1 is a top view of a ventilated box cutout.
Figure 2:
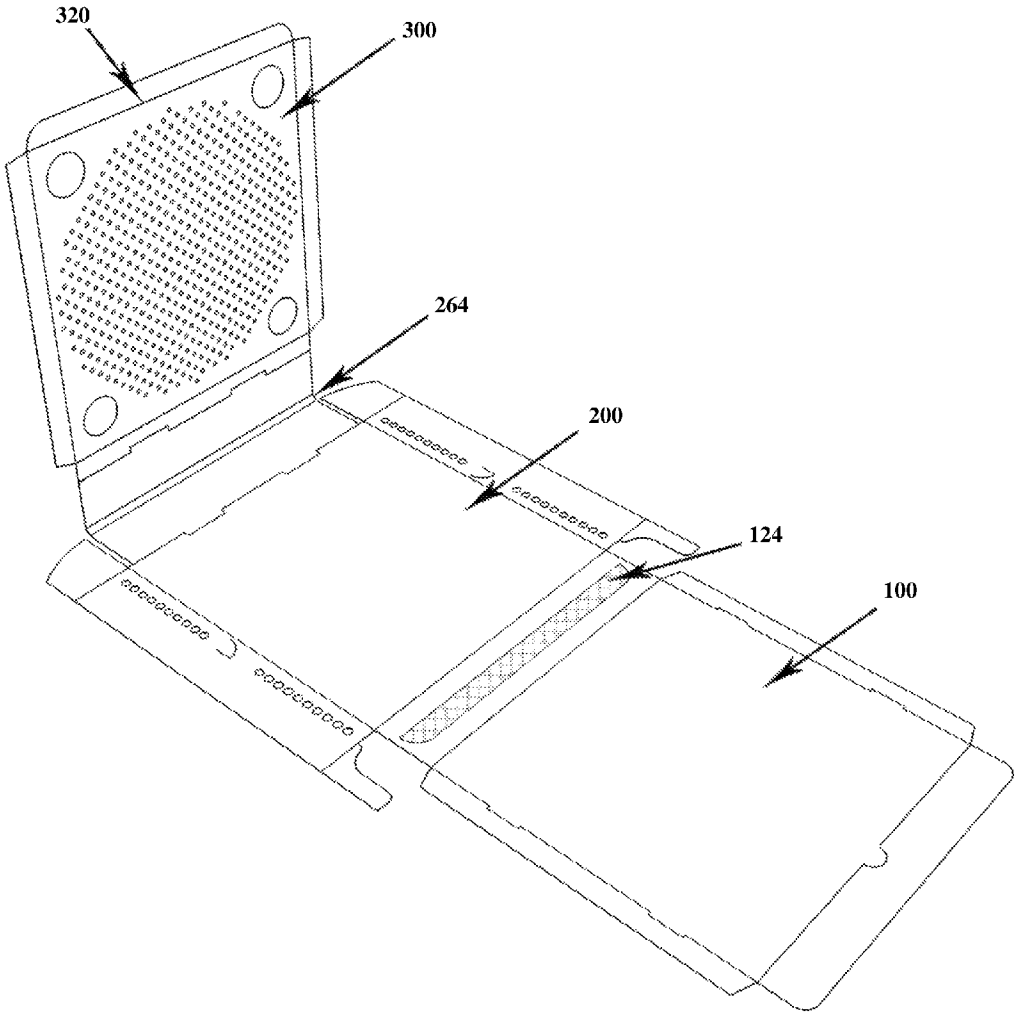
FIGS. 2-12 are perspective views of a ventilated box at various stages of folding and attachment.
Figure 3:
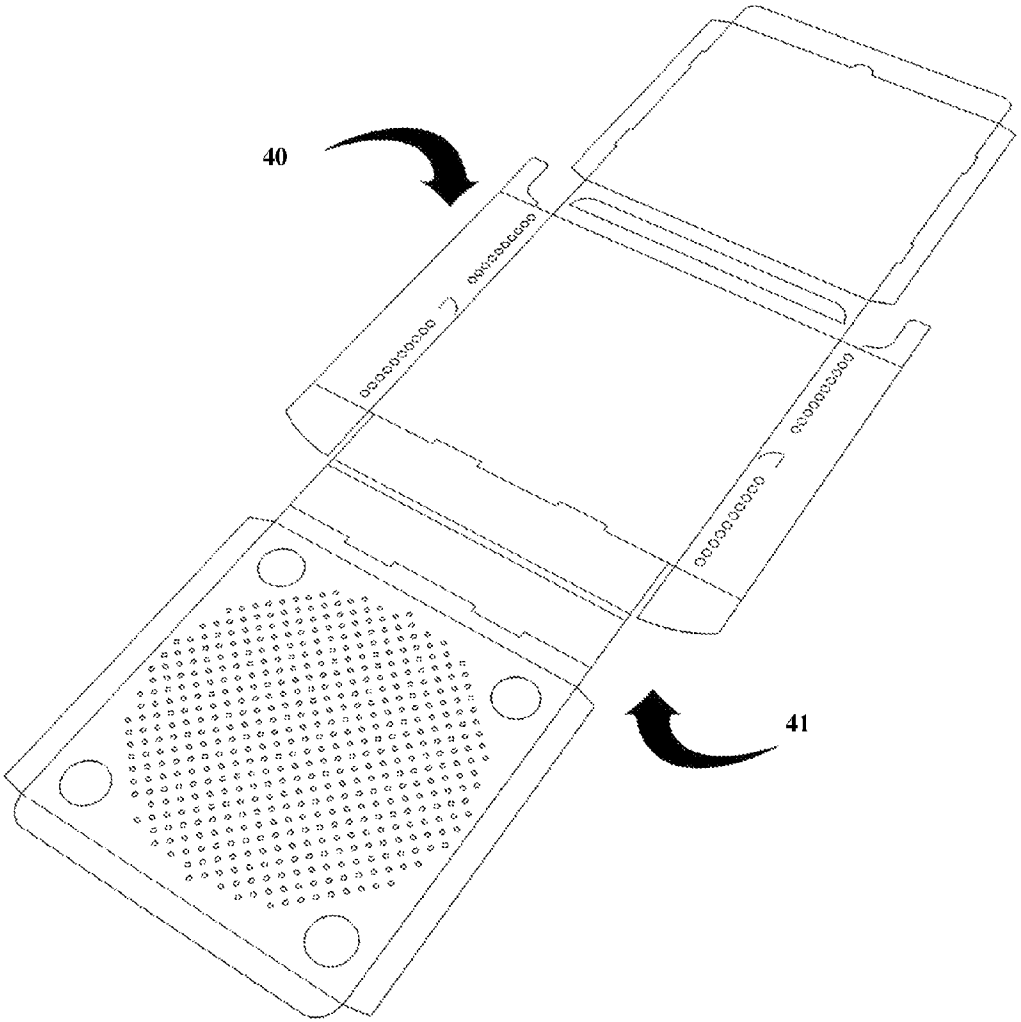
Figure 4:
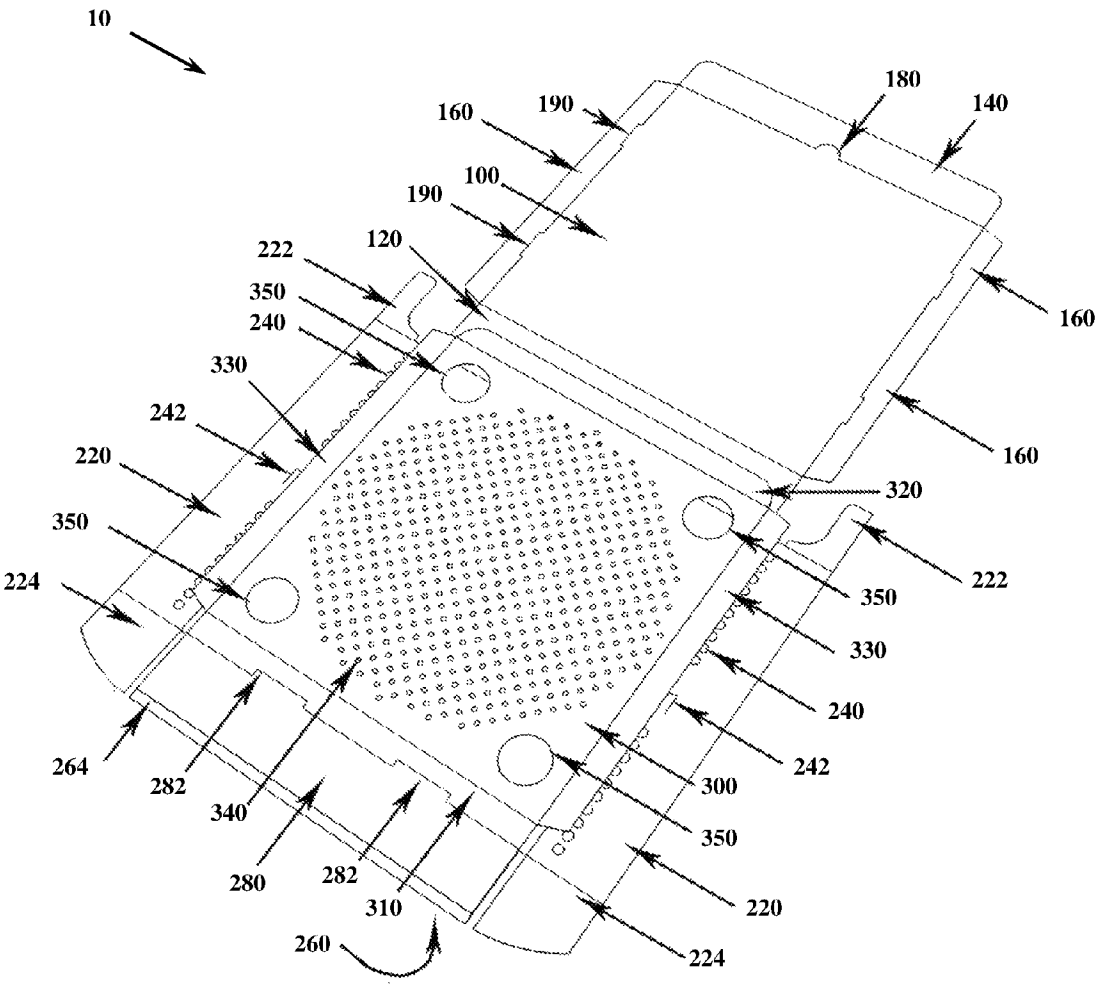
Figure 5:
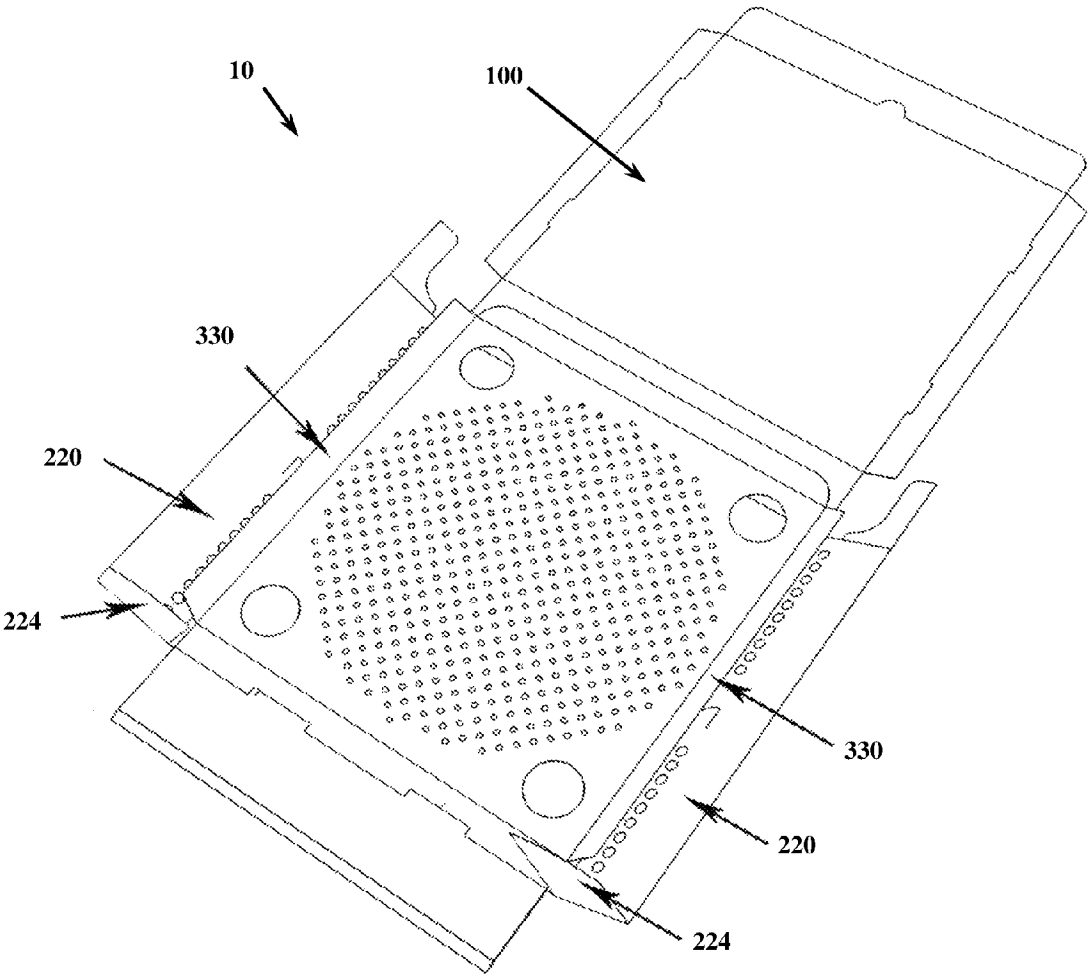
Figure 6:
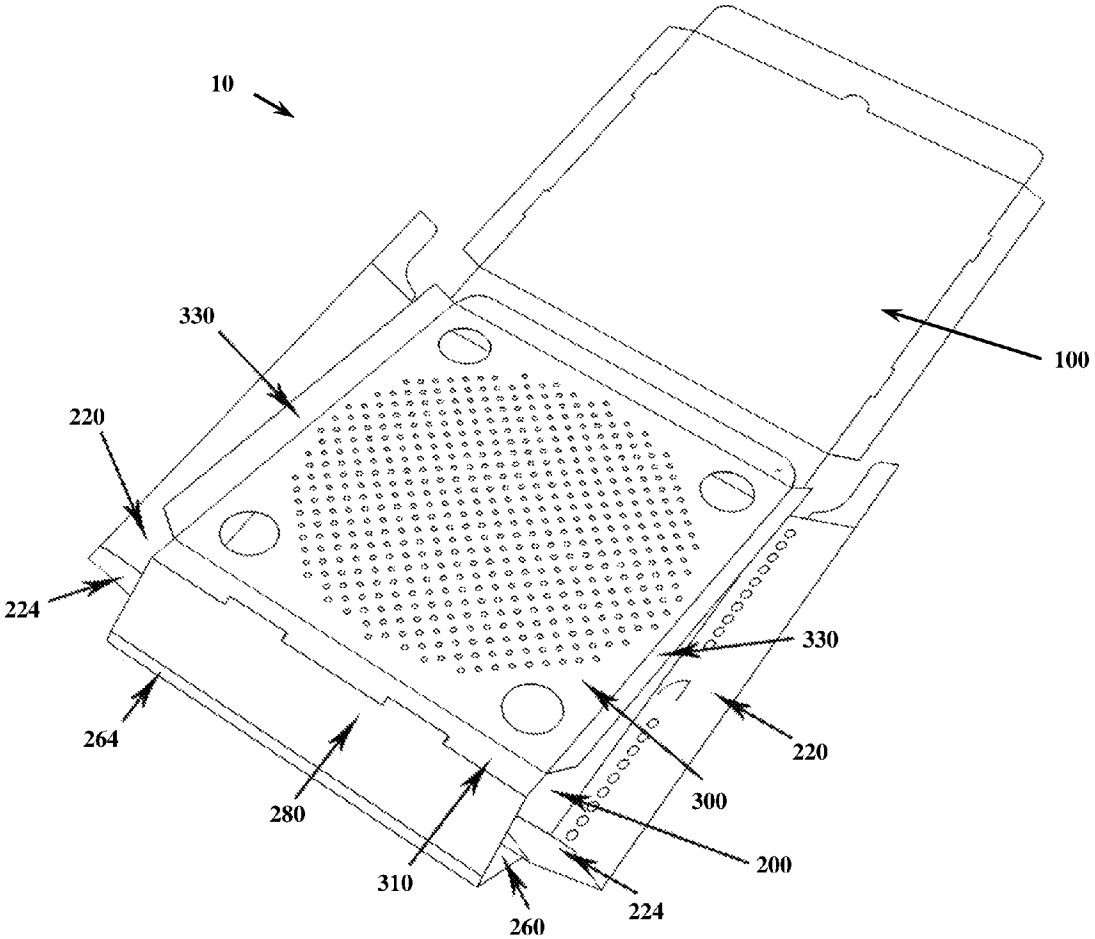
Figure 7:
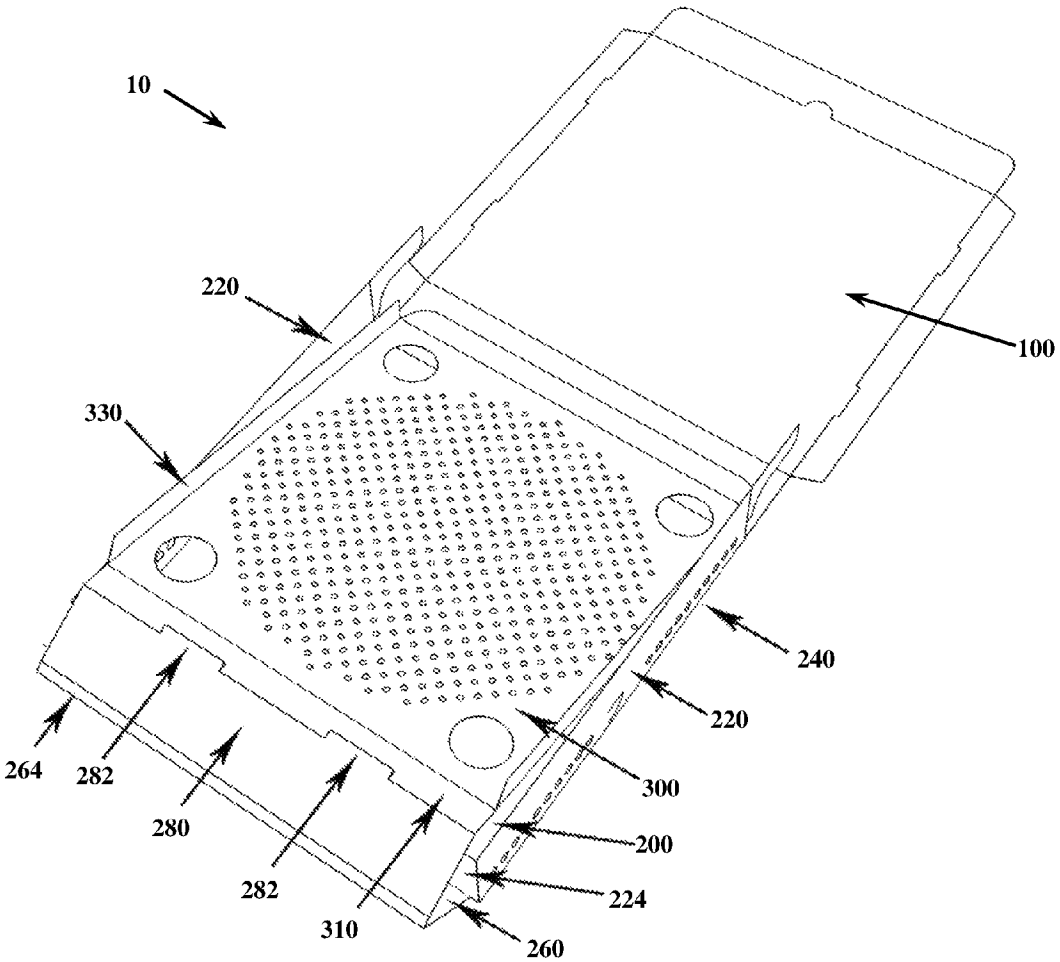
Figure 8:
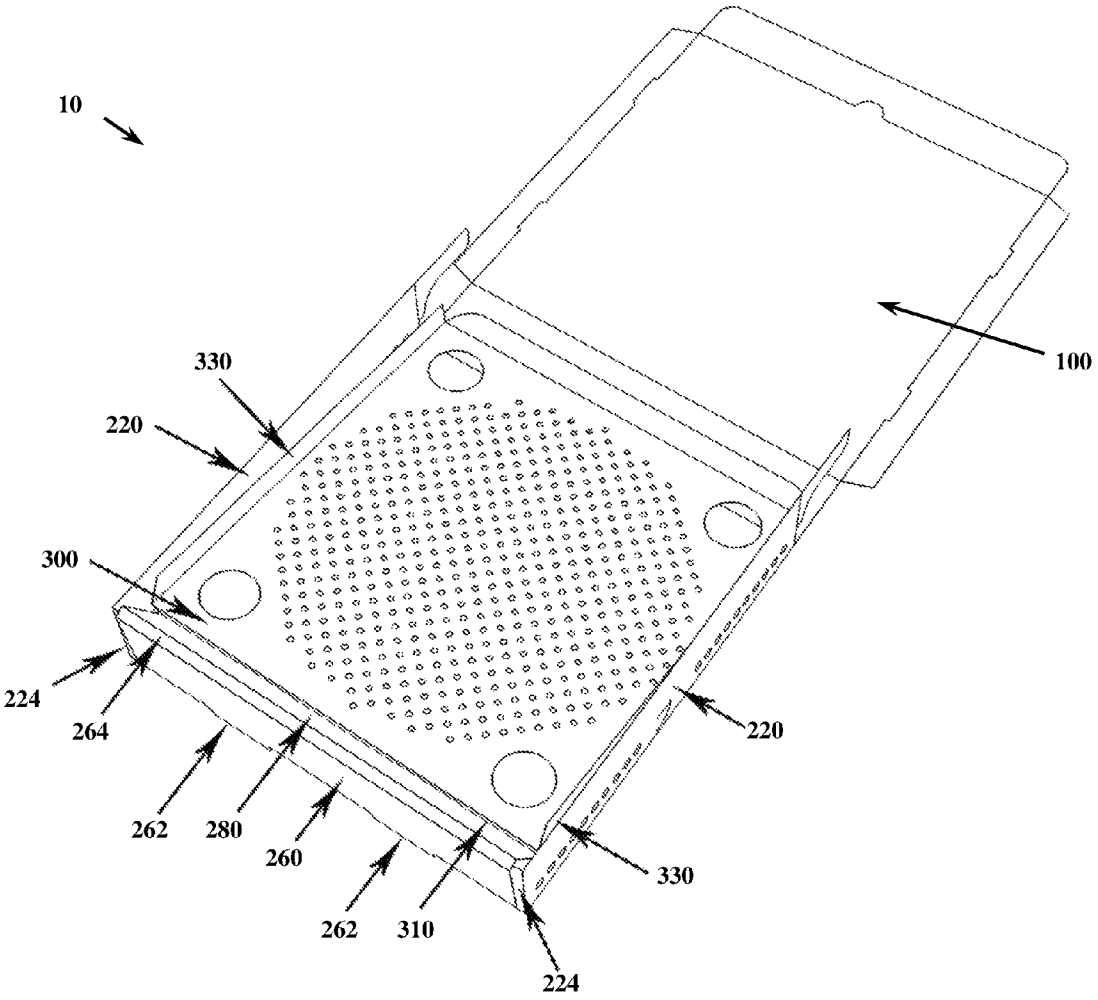
Figure 9:
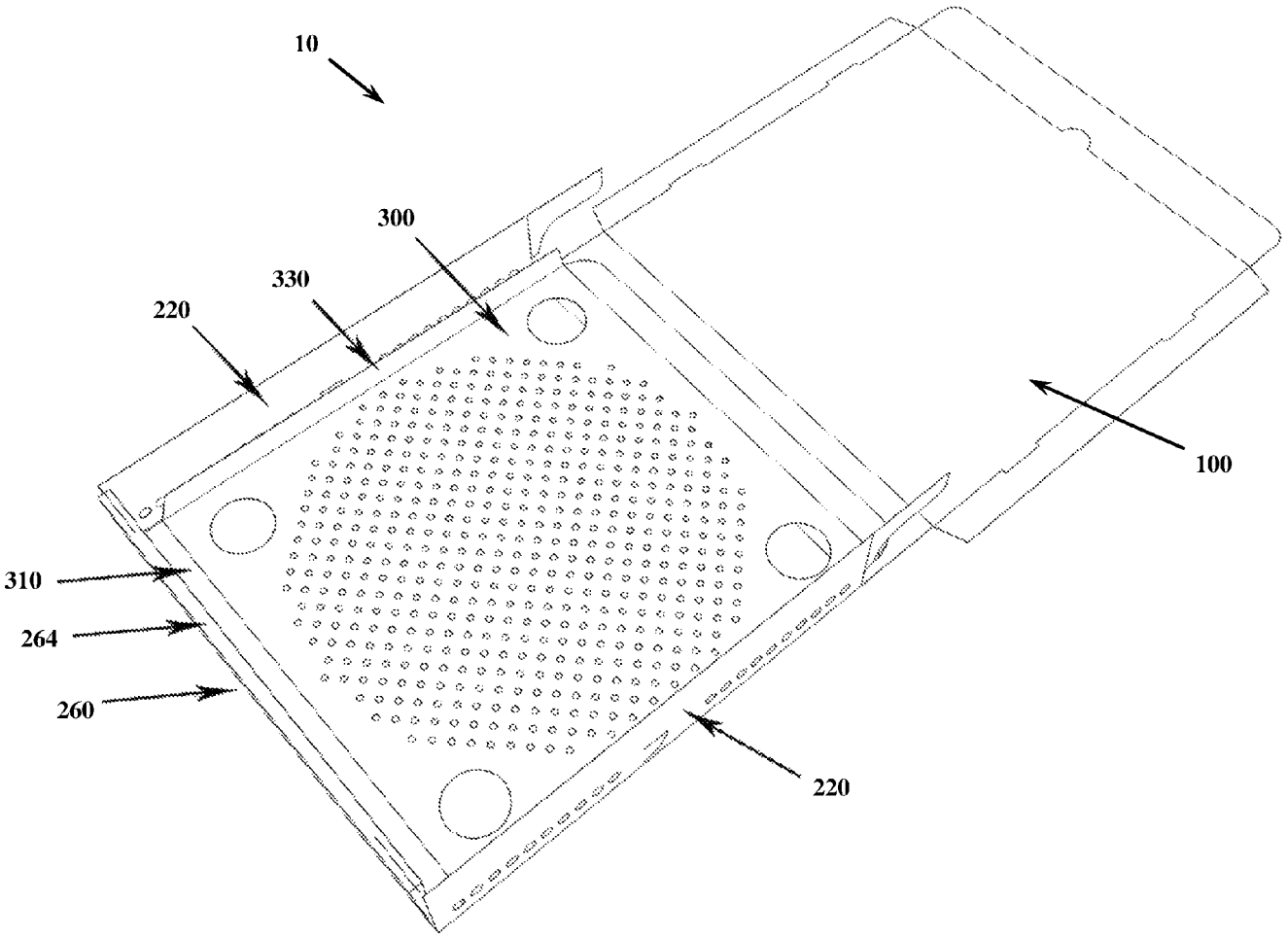
Figure 9A:
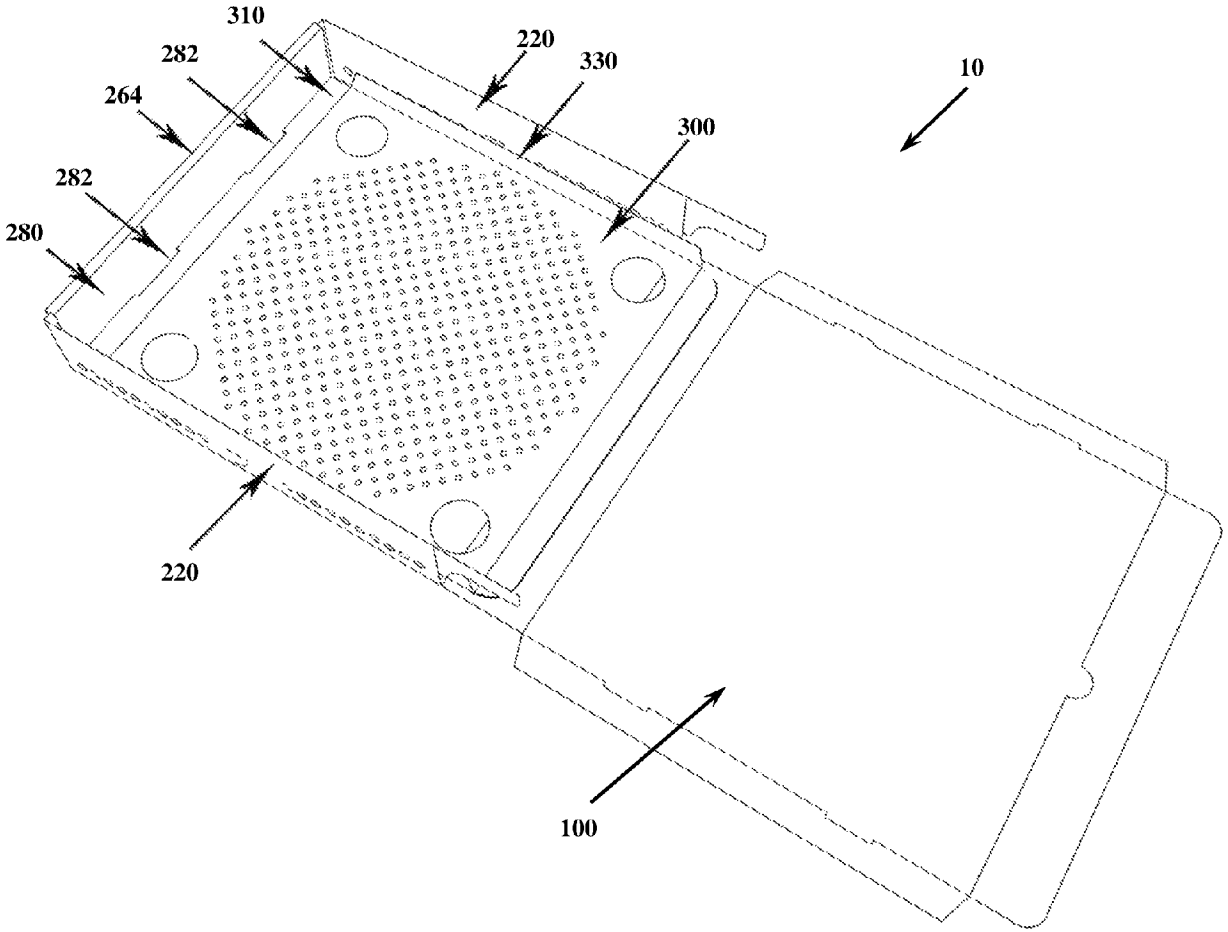

Starting with FIG. 1, the box 10 cutout is depicted in a flat unfolded configuration. Directions of the top side 40 and under side 41 of the cutout are shown in FIG. 3. In a sense, the main portions of the box may be identified as the top panel 100, the bottom panel 200 and the tray 300. The bottom panel 200 is foldably connected to the sidewalls 220, the rear wall 120 and the front wall 280/260. Specifically, the front wall comprises an inner front wall portion 280 foldably connected to an outer front wall portion 260. In the exemplary embodiment shown, the inner 280 and outer 260 front wall portions are adjoined via a front wall spacer 264 such that the front wall portions 260/280 fold along the along the spacer 264, as shown in FIG. 2. In certain implementations, such as where a thicker material is not used to manufacture the box, the spacer 264 may not be needed. Also as shown, the inner front wall 280 and the tray 300 are connected through a foldable tray rear flap 310.

In the exemplary embodiments, the tray and the rear wall are adapted to attach to each other. This may be accomplished in a variety of ways. For instance, the rear wall, the tray or both may comprise an adhesive. As another example, the rear wall and tray may comprise complimentary elements which mechanically interlock. Other similar methods of attachment available to a person skilled in the art may be employed here to support the mechanical action of the box further described below.

As shown in the exemplary embodiments, the rear wall 120 comprises a tray attachment receiving portion 124 and the tray 300 comprises a tray attachment portion. In the example shown, the tray attachment portion is located on the tray 300 side opposite the side attached to the front wall. In FIGS. 1-12, a foldable tray front flap 320 comprises the tray attachment portion. In these examples, the tray attachment receiving portion 124 is a portion of the rear wall comprising an adhesive strip. The box 10 is therefore dimensioned such that when the tray 300 is folded over the bottom panel 200, the tray front flap 320 meets and attaches to the tray attachment receiving portion 124.

FIGS. 4, 5, 9 and 9*a* illustrate a box 10 when the attached tray 300 is in a collapsed position. In this position, the tray 300, tray front flap 320 and tray rear flap 310 are positioned substantially in the same plane. This feature can be beneficial because it allows, for example, a pizza to be placed in the box and cut before the tray is elevated. As shown in FIGS. 6-9, once the tray portion is attached, the side walls 220 may be folded up towards the bottom panel 200 allowing the side wall front tabs 224 to be inserted into the space between the outer front wall 260 and inner front wall 280. This assists in securing the side walls 220 in a substantially vertical position.

Additionally, the inner front wall 280 can comprise cutout tabs 282 located along the folding line between the inner front wall 280 and the tray rear flap 310. Similarly, the outer front wall 260 can comprise cutout tabs 262 along the folding line between the outer front wall 260 and the bottom panel 200. The cut out tabs are dimensioned such that upon folding the inner and outer front wall portions together, the inner front wall tabs 282 fit into the slit around the outer front wall tabs 262. Such connections may provide additional support and stability for the box 10.

Figure 10:
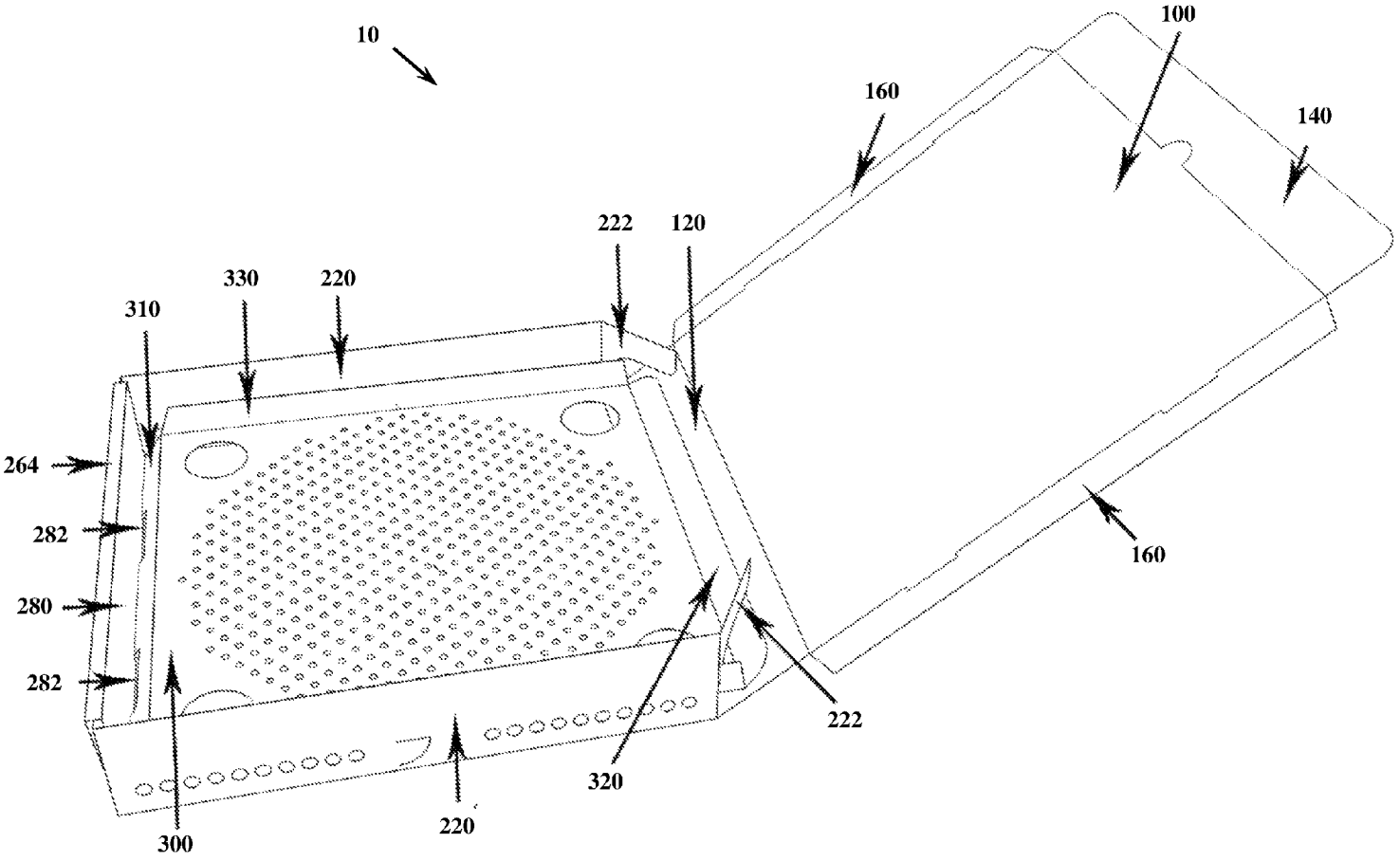
Figure 11:
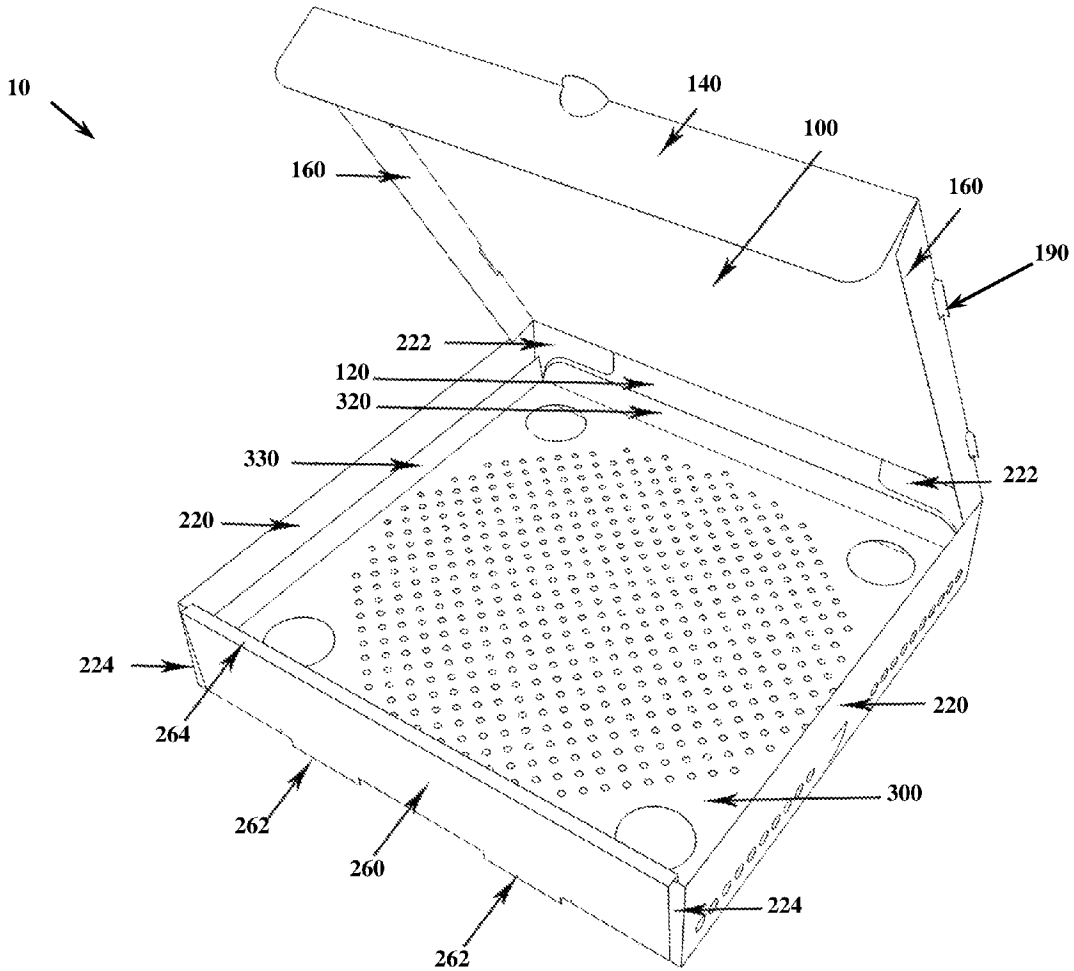
Figure 12:
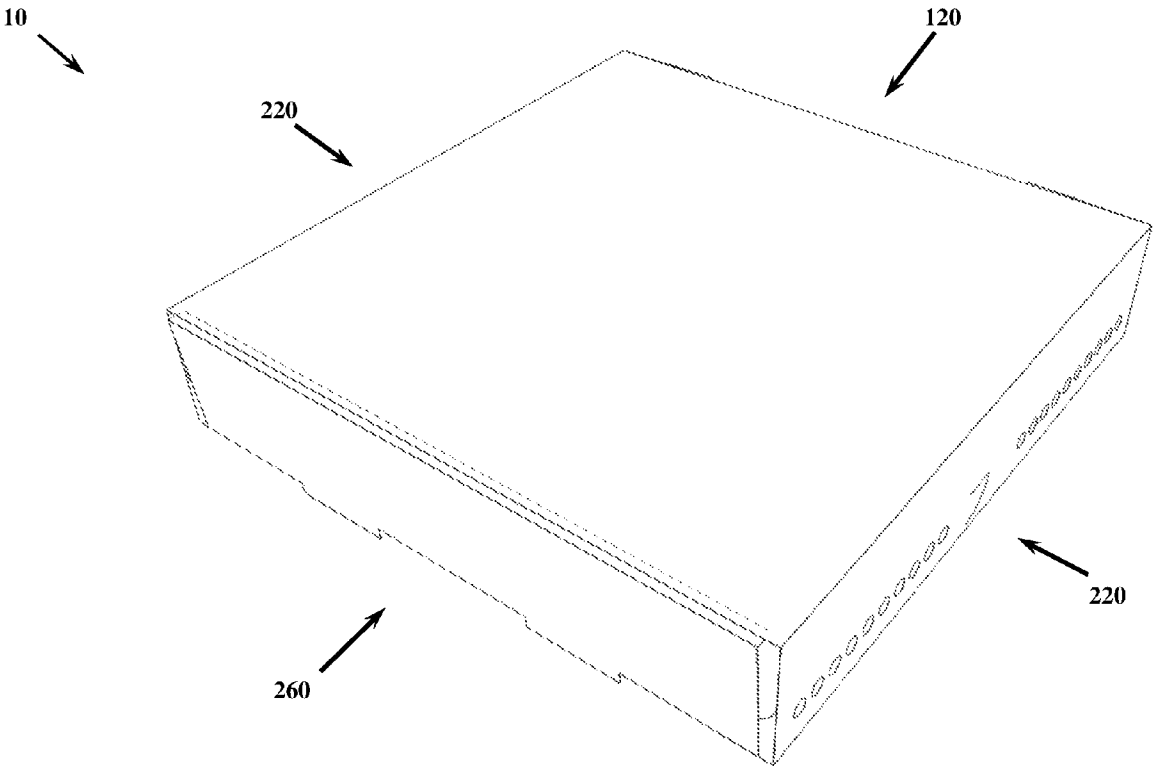

In the exemplary embodiments, the top panel 100 also comprises side flaps 160, a front flap 140 and a front tab 180. FIGS. 10-12 depict the top panel 100 folding toward the bottom panel to close the box 10. As shown, the top panel side flaps 160 and front flap 180 are folded inward such that upon closing the box, they engage the inside of the side walls 220 and front wall 280, respectively. During closing, the sidewall rear tabs 222 are folded towards each other to provide additionally support for the side walls 220 and top panel 100.

Furthermore, the top panel 100 can comprise side tabs 190 which jut out when the side flaps 160 are folded in. Similarly, the front tab 180 extends out when the front flap 140 is folded in. Accordingly, when the box 10 bears weight placed on the top panel, the side tabs 190 resting on the side walls 220 and the front tab resting on the front wall, may provide some support in preventing the top panel 100 from sinking into the box.

Figure 16:
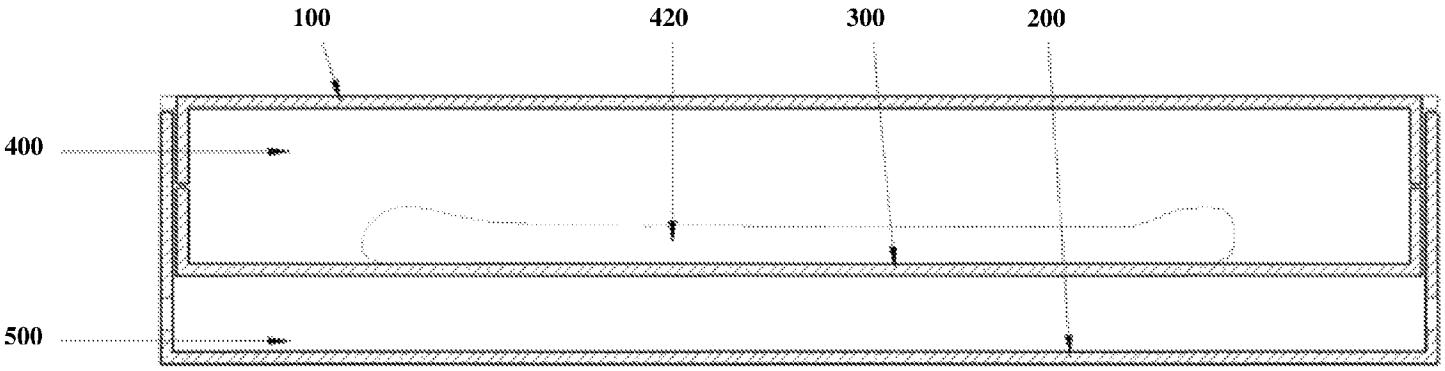
FIG. 16 is a front cross-sectional view of a ventilated box.
Figure 17:
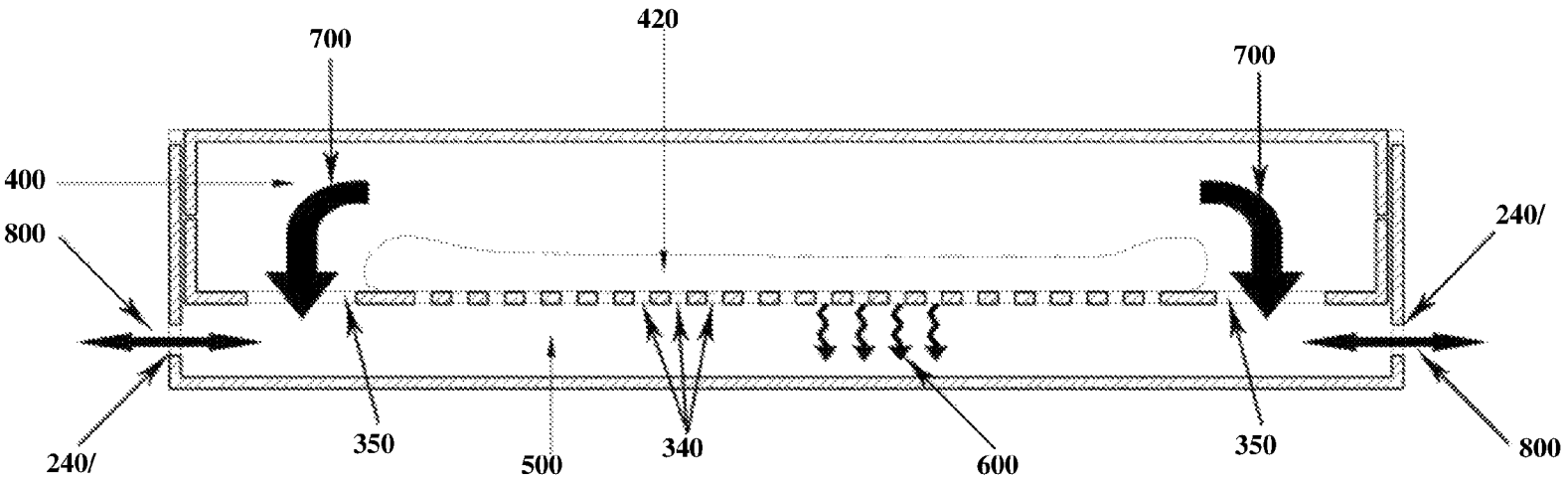
FIG. 17 is a front cross-sectional view illustrating heat and air flow in a ventilated box.

The box 10 depicted in the exemplary embodiments comprises an upper and a lower compartment. As shown in FIGS. 16 and 17, the box folded in the final configuration can comprise an upper compartment 400 which may be defined at least by the space between the tray 300, the front wall 280, the rear wall 120 and the side walls 220. Of course, this space of the upper compartment is further defined by the top panel 100, when the box 10 is closed.

Below the upper compartment, the box 10 comprises a lower compartment 500 defined by the space between the tray 300, the front wall 280, the rear wall 120, the bottom panel 200 and the side walls 220. When the tray 300 is in a collapsed position, the lower compartment 500 space is smaller compared to the space when the tray 300 is in a raised position. The side cross-sectional view in FIG. 14 and rear cross section view in FIG. 15 further depict the two compartments as well as the position of the tray flaps 330 and 320 and the and top panel flaps 160 and 140 when the box is closed.

Figure 13A:
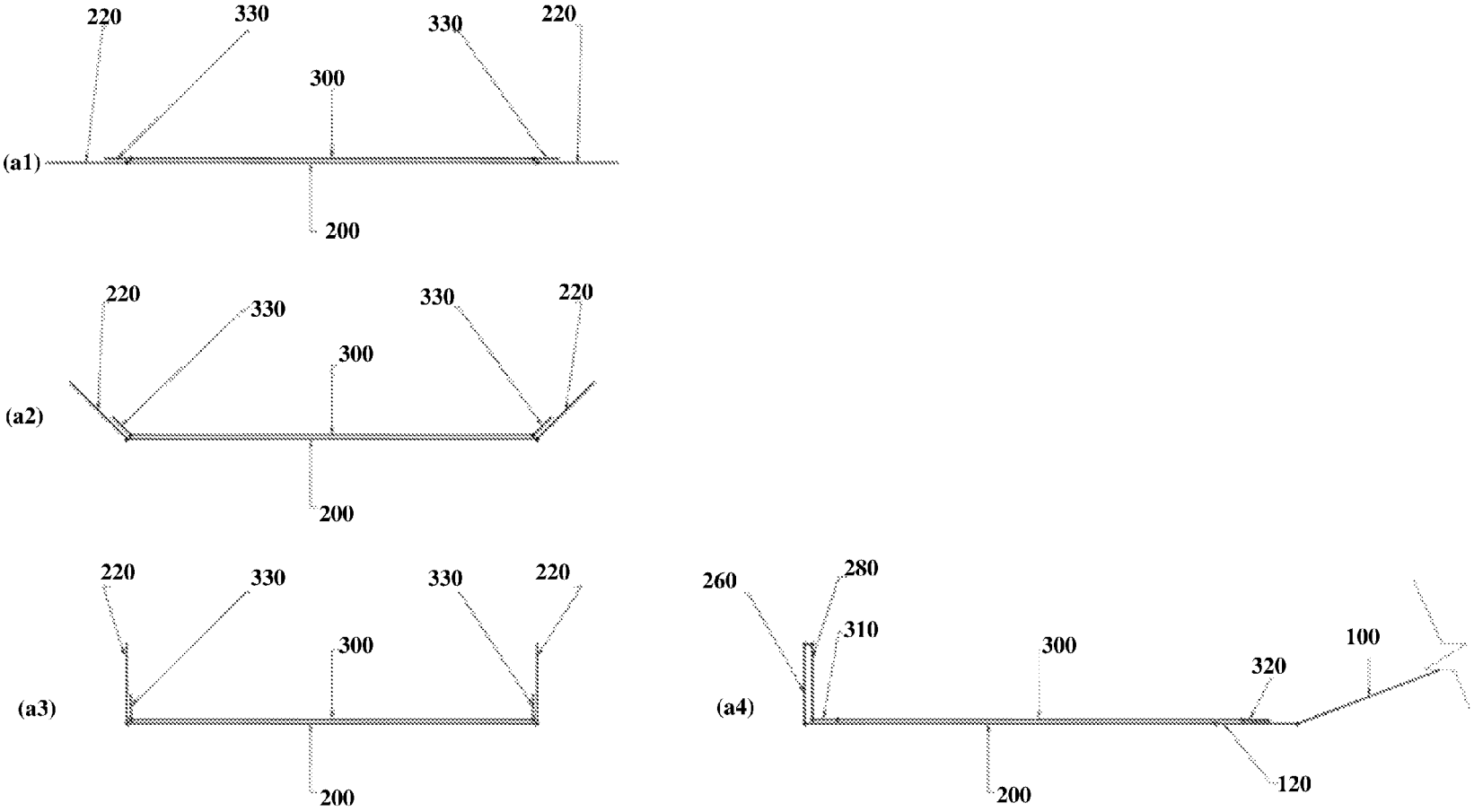
FIGS. 13*a*-13*b* are side cross-sectional representations of a ventilated box illustrating the position of various portions during folding.
Figure 13B:
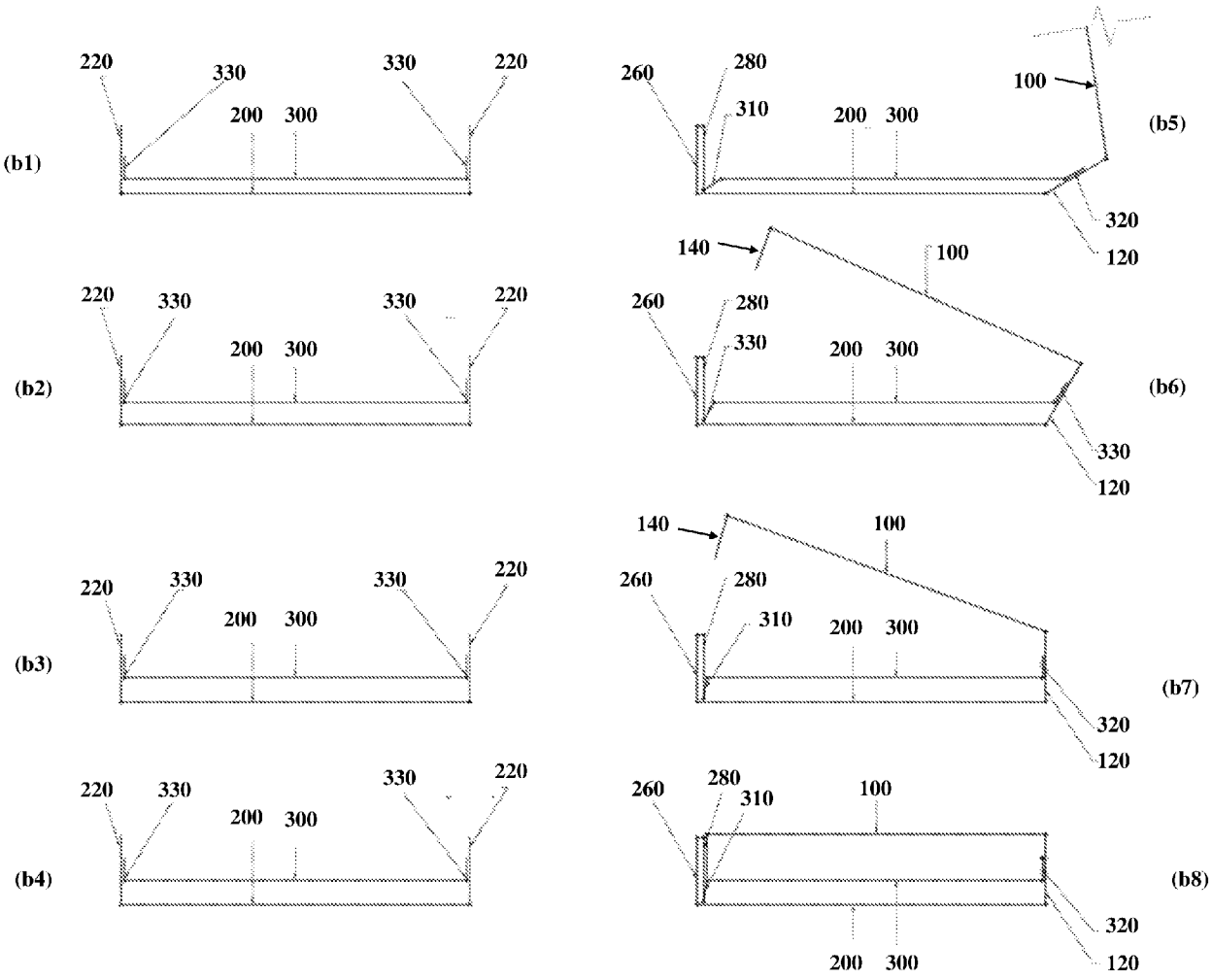

The ventilated boxes of the exemplary embodiments may be configured to move the tray portion between a raised and a collapsed position. This feature allows a user to place a food item on the tray portion while in a collapsed position, for example for cutting pizza, and subsequently move the tray to an elevated position to take advantage of the ventilation system which is described in further detail below. FIGS. 13*a* and 13*b* provide schematics illustrating this feature. As shown in the front cross-sectional views of stages a1-a3, the box is configured by folding the side walls 220 inward causing the tray side flaps 330 to also fold inward. Upon attaching the tray front flap 320 to the rear wall 120, as shown in the side cross-sectional view in stage a4, the space between the inner front wall 280 and the outer front wall 260 is then available for inserting the side wall 220 front tabs (not shown) as previously described. The schematic also illustrates the tray 300 sitting on bottom panel 200 in a collapsed position.

The cross-sectional representations shown in FIG. 13*b* depict the tray in an elevated position and illustrate the relative action of the various portions of the box during closing. Beginning with stage b5, as the top panel 100 is lifted and folded towards the bottom panel 200 the rear wall also begins to fold upward toward the front wall 280. Also shown, the tray front flap 320 is attached to the rear wall 120 and tray rear flap 310 is connected to the inner front wall. Accordingly, as the rear wall 120 is urged toward the front wall 280 the tray is pushed due to the attachment of the portions. Specifically, this action of the rear causes the front flap 320 to fold upward, tray rear flap 310 to fold downwards and the tray 300 to lift to elevated positions. The box is dimensioned such that when the top panel 100 is folded over the bottom panel and the front flap 140 is tucked into the box, the tray front flap 320 and rear flap 310 are folded nearly perpendicular to the tray 300.

FIGS. 12 and 14-19 provides examples of the box in the final closed configuration. Here the tray side flaps 330, which are folded during the folding process, provide structural support for box from the weight of the pizza 420 resting on the tray 300 once the tray is in the elevated position. The tray is further supported at the front of the box 10 by the tray rear flap 310 which is folded down and contacting the bottom panel 200. At the rear, the tray is also support by the attachment of the tray front flap 320 to the rear wall 120.

In the exemplary embodiments, the relative action of the box portions allow a user to utilize the tray in the collapsed position, for example when cutting pizza, and also take advantage of the ventilation system by raising the tray to the elevated position. The ventilation system of the exemplary embodiments is aided by the strategically located perforations. Cut out portions are also provided to further assist in ventilating the compartments. For instance, FIG. 1 shows the folded out box 10 is manufactured with sidewall perforations 240, a first tray perforation 340 and second tray perforations 350. The first 340 and second tray portions 350 may be differently sized to facilitate air movement between the upper 400 and lower 500 compartments.

In the exemplary embodiments, the tray 300 comprises first perforations 340 and second perforations 350. Although the first perforations 340 are shown to be arranged in a circular shape, this arrangement may take on any other shape desired for liquid or air flow. In exemplary embodiments, the cooler air exchange through the first tray perforations 340 may assist in maintaining the crust crisp.

The second perforations, 350 may act as hot air overflow vents. The size of the first and second perforations may differ based on the degree of air flow desired. As shown in the examples, the second perforations 350 are larger and are located at the periphery of the tray 300. Accordingly, as the steam accumulates in the upper compartment 400, in a delayed manner it will find a way out of the box through the tray perforations. The system here is designed to prevent rapid steam flow out of the upper compartment 400 as this can cause the pizza 420 to become soggy. As the steam builds, the perforations 340/350 permit excess steam to leave the upper compartment 400 into the lower compartment 500 to ensure enough steam remains in the upper compartment to keep the pizza warm and the ingredients moist.

Figure 14:
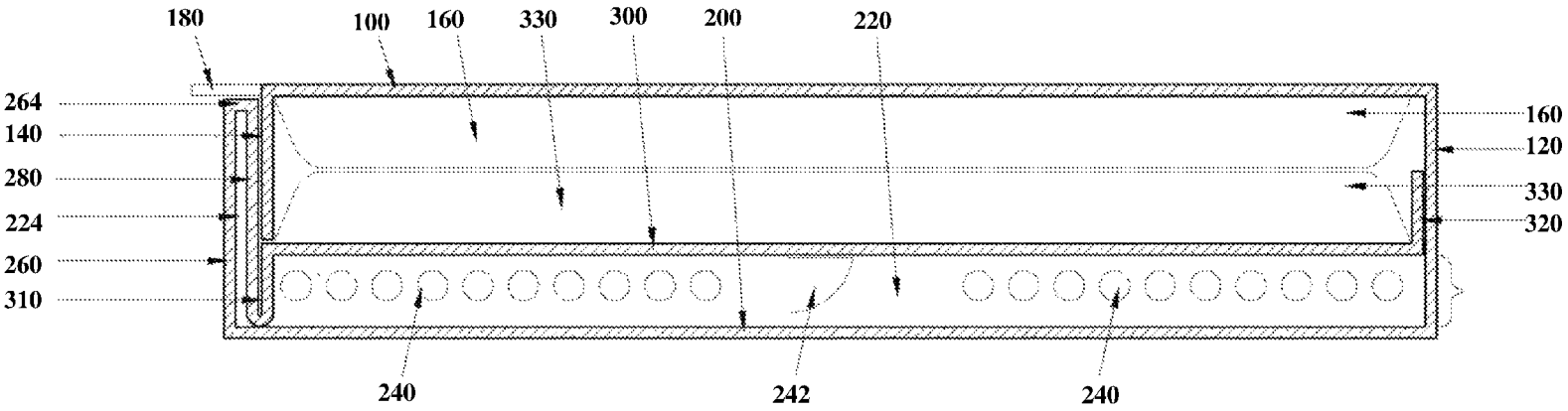
FIG. 14 is a side cross-sectional view of a ventilated box.
Figure 15:
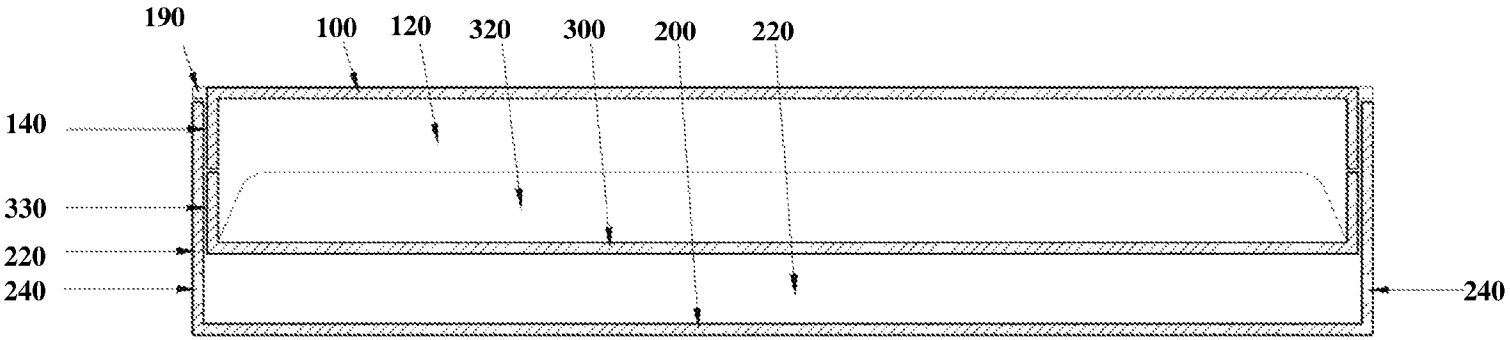
FIG. 15 is a rear cross-sectional view of a ventilated box.
Figure 18:
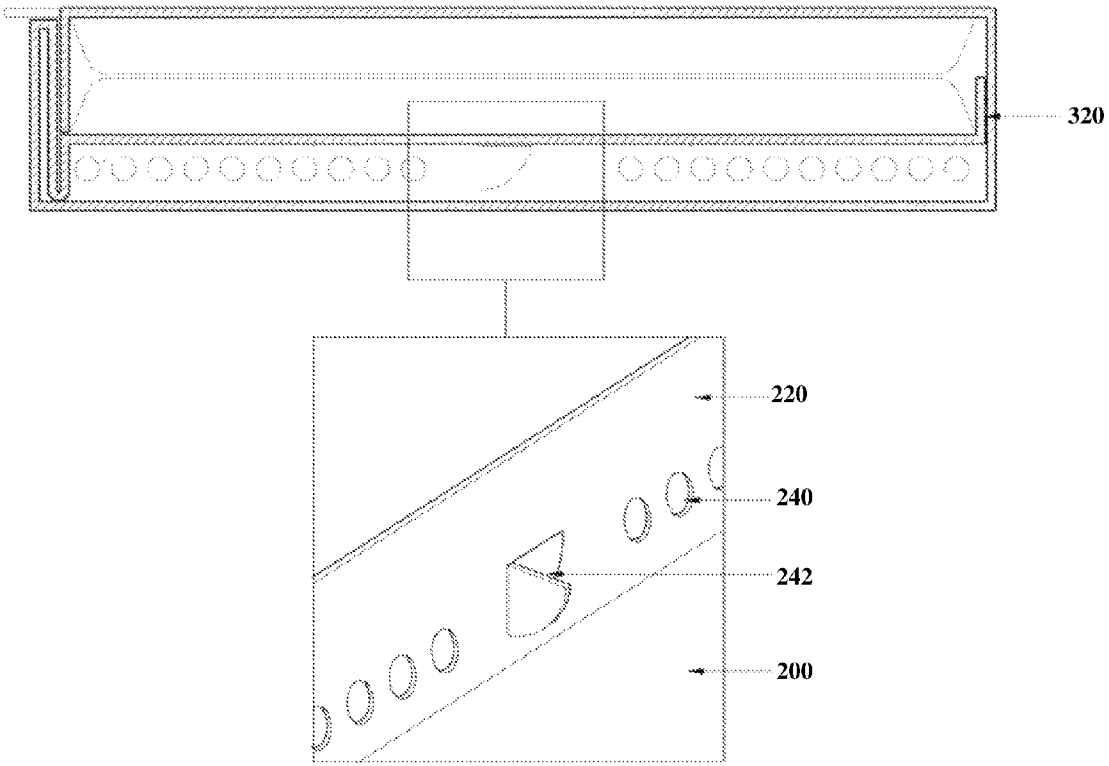
FIG. 18 is a side cross-sectional view magnifying certain details of a ventilated box.

As shown in the exemplary FIGS. 14 and 18, the sidewall 220 can comprise perforations 240 located adjacent to the lower compartment 500. Although not shown, the present disclosure also contemplates front wall or rear wall perforations in combination with, or in lieu of, the side wall perforations 240. The location of the side wall, front wall or rear wall perforations enables steam 700 emanating from a pizza 420 located in the upper compartment 400 to travel into the lower compartment 500 instead of directly escaping from the upper compartment 400 to the exterior of the box. As such, in an exemplary embodiment, the rear wall, front wall or side wall portions adjacent to the upper compartment are not perforated. Although some steam may seep through top portion of the closed box, it is believed that the majority of the steam leaving the upper compartment 400 enters the lower compartment 500. In an exemplary embodiment the warm steam 700 in the lower compartment may serves as a heat source to maintain the pizza warm. The sidewall perforations 240 are sized to permit air exchange 800 between the lower compartment 500 and the box exterior, without rapidly depleting the warm air. If additional ventilation is required, the side wall cutouts 242 may be opened to release more steam.

Also, as shown in FIG. 17, both heat and liquids 600 emanating from the pizza 420 pass through the first tray perforations 340 into the lower compartment 500. In some instances the pizza ingredients produce a high volume of steam which can condense into liquid. The tray perforations therefore allow this excess liquid to pass through the tray and collect in the bottom tray. To this end, an exemplary embodiment further includes an absorbent material or coating on the bottom panel to soak up the excess liquid. This can prevent liquids from dripping out of the box. As yet another example, a waterproof lining may be employed at the location of the perforations on the side of the box to prevent liquid flowing out of the box. The sidewall perforation 240 and cutout 242 may be placed at a position above the bottom panel 200 to prevent liquid flowing out from them.

In some instances, a coating of heat reflective foil can be added to one or more inner surfaces of the box to enhance heat retention. For example, the upper compartment or the entire interior of the box may be lined with a reflective coating. Although this may increase production cost, for food items that are highly sensitive to temperature change, this may be a viable solution.

Figure 20:
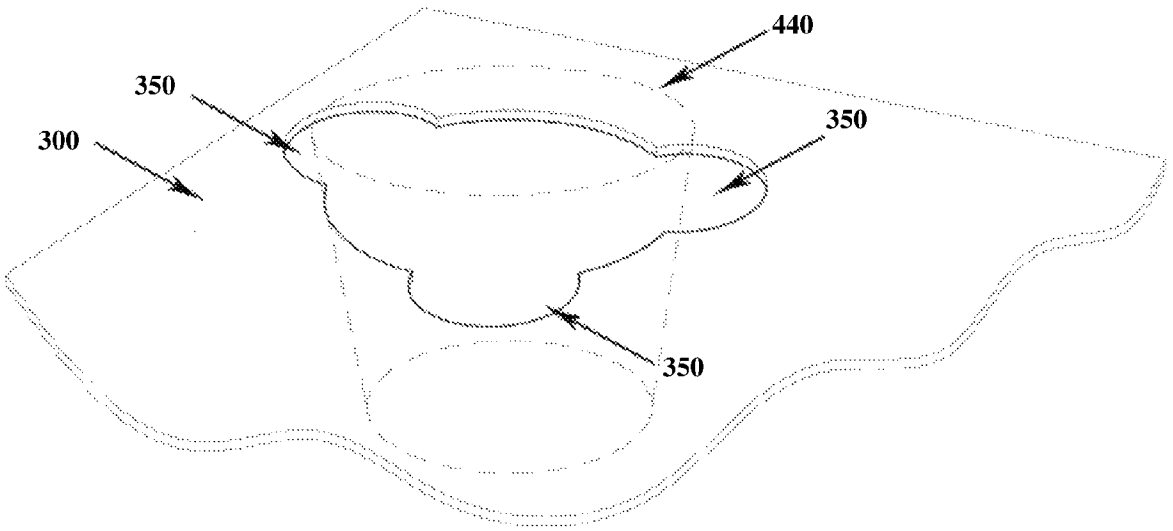
FIG. 20 is a magnified view of a portion of the ventilated box.
Figure 21:
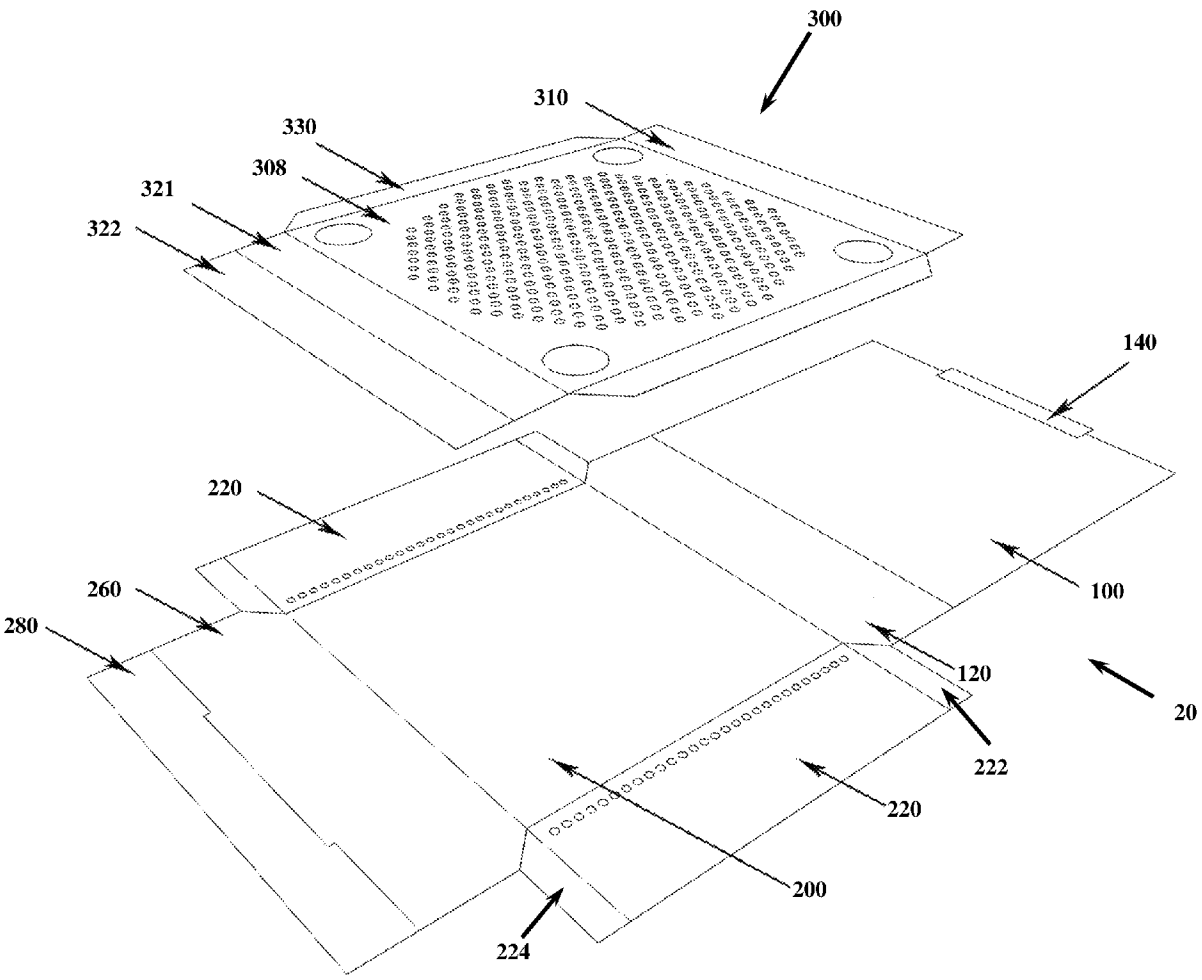
FIGS. 21-28 are perspective views of a ventilated box in accordance with an exemplary embodiment at different stages of folding and attachment.
Figure 22:
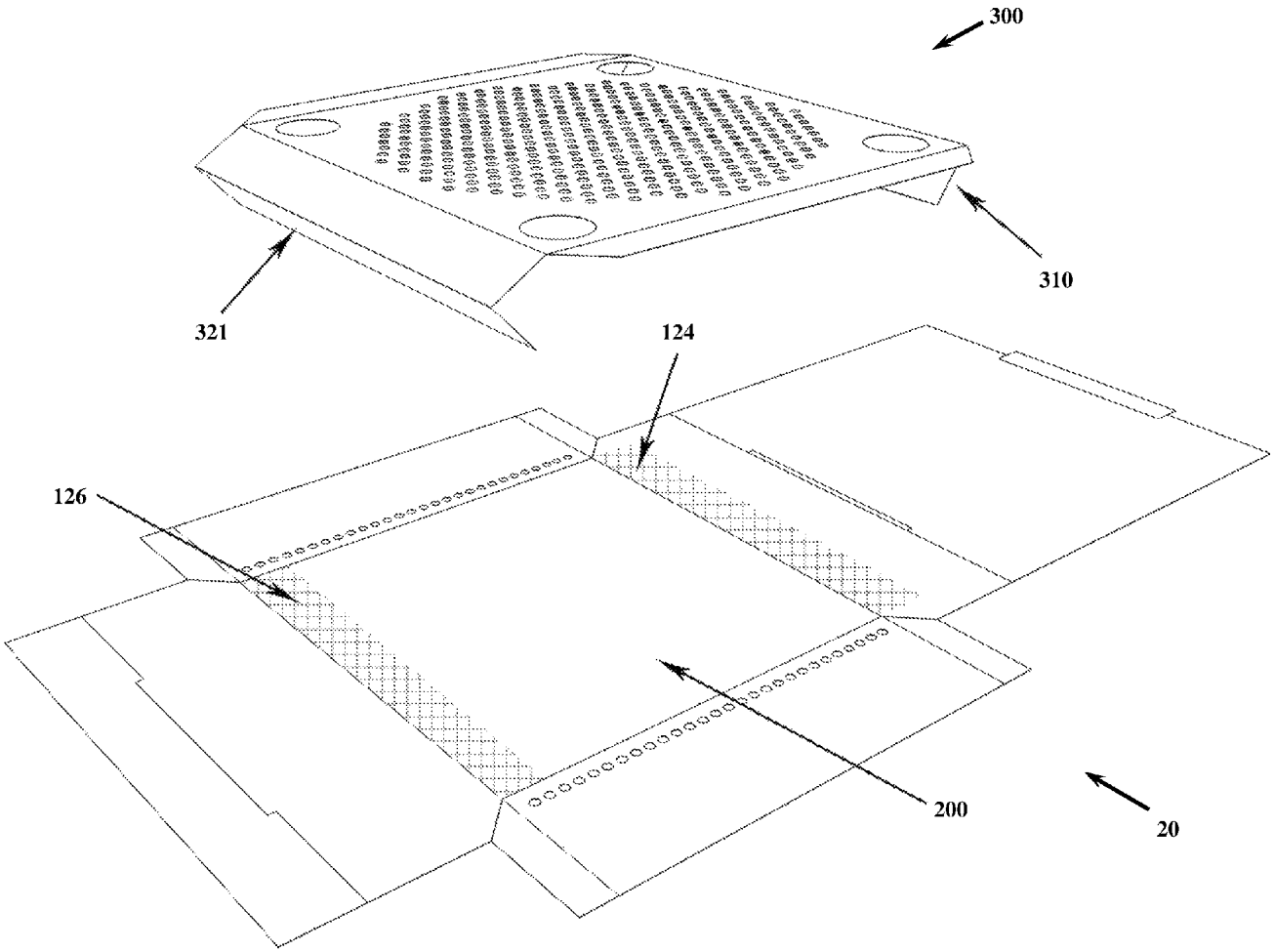
Figure 23:
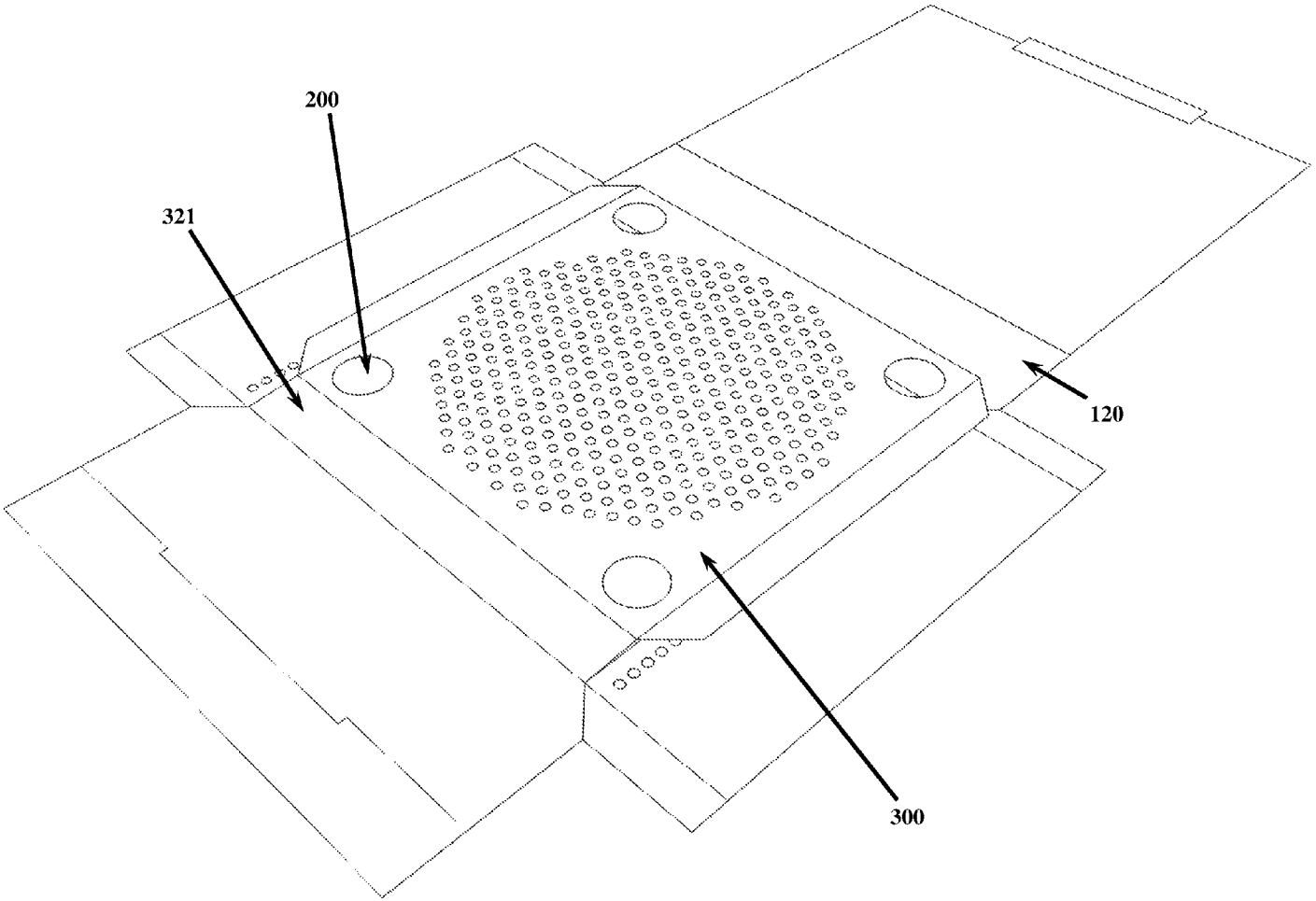
Figure 24:
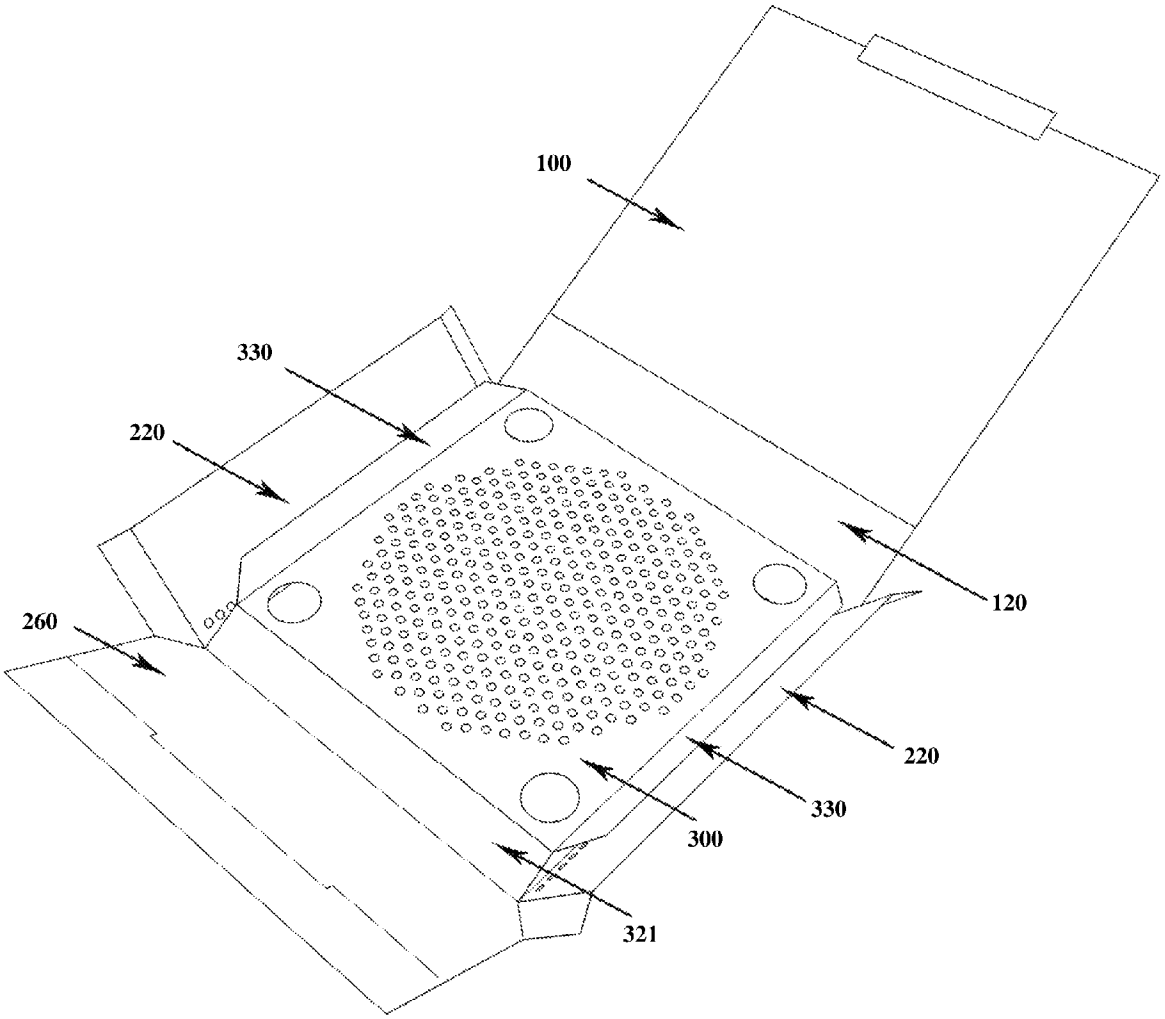
Figure 25:
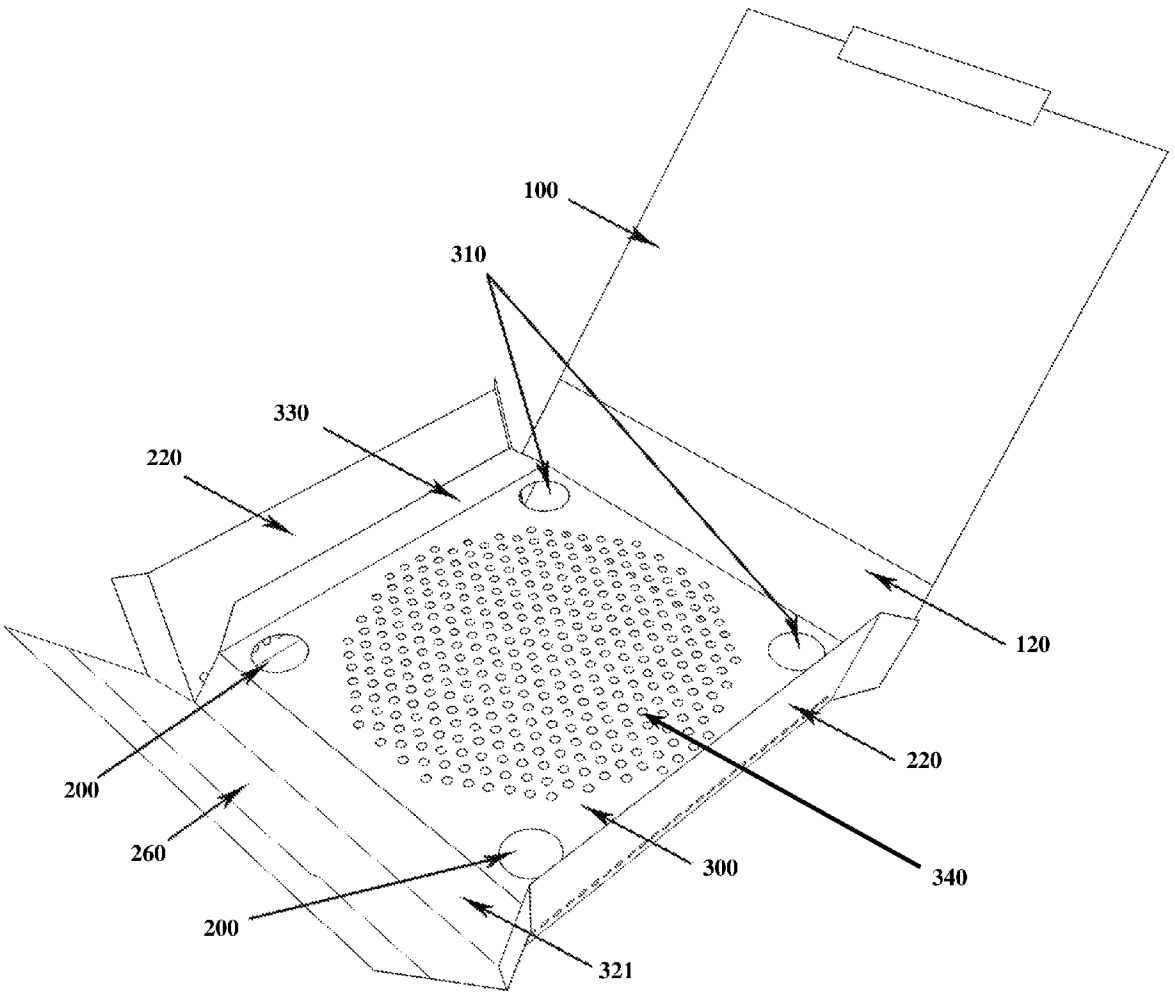
Figure 26:
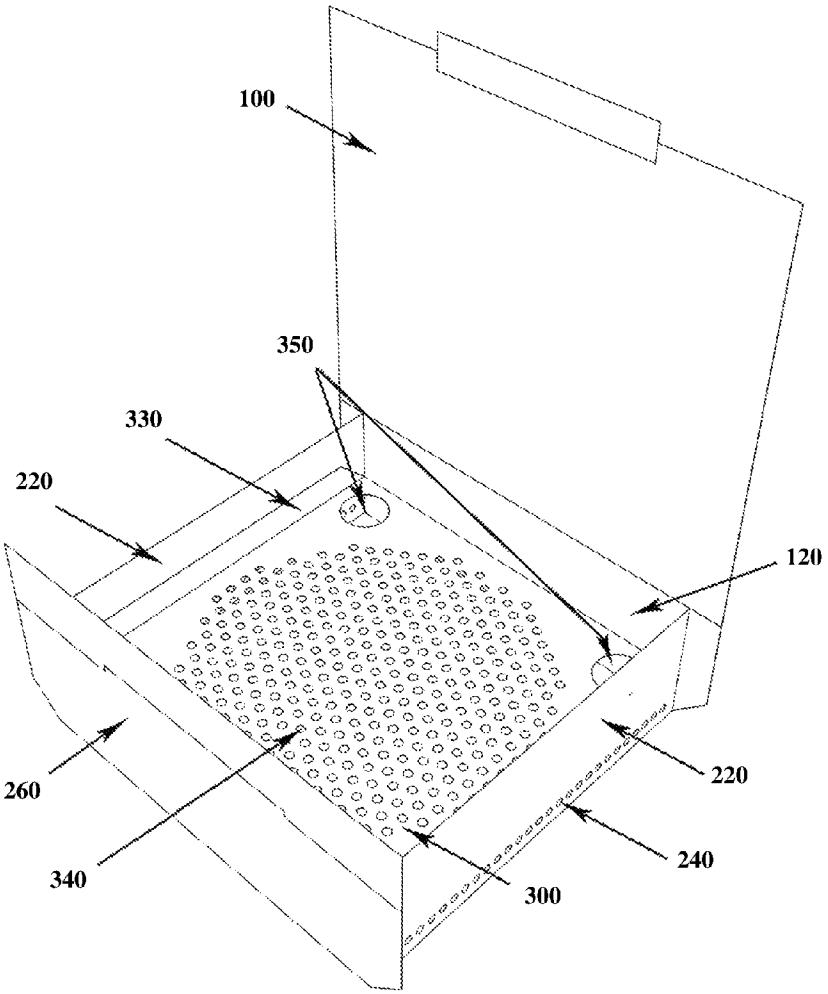
Figure 27:
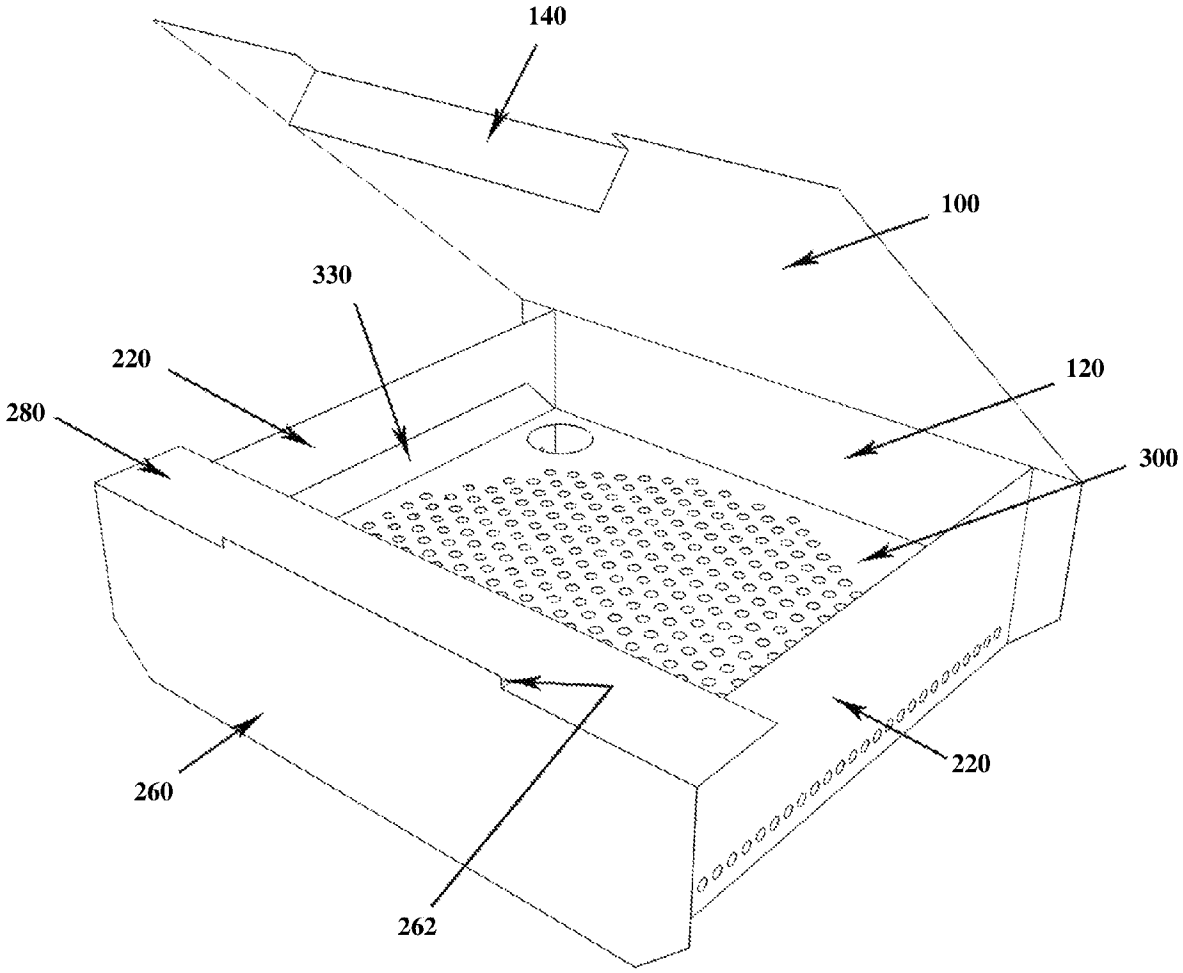
Figure 28:
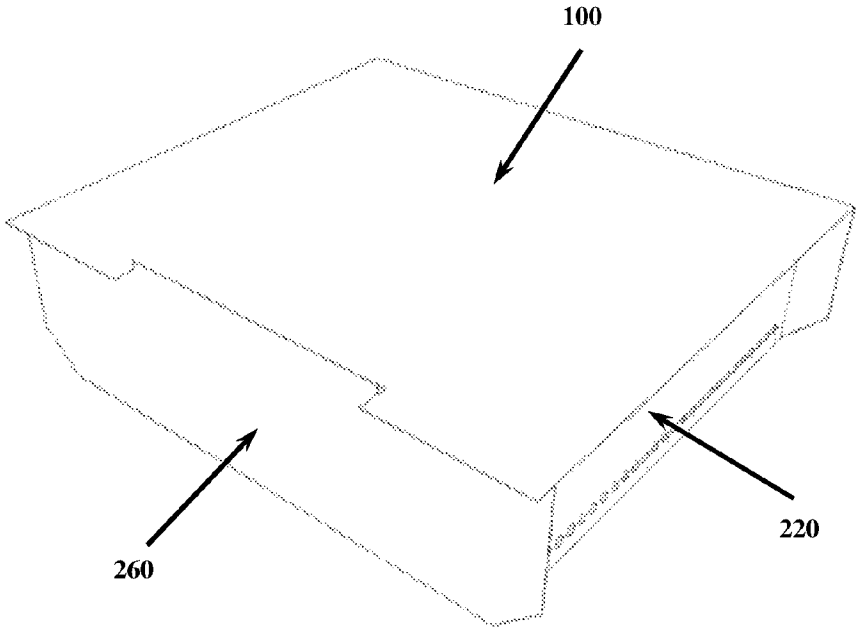

Additional ventilation is available for food items that produce more steam as detailed in FIG. 18. In this example, the sidewall cutout 242 located next to the perforations 240 may be opened to let out more steam from the lower compartment. Moreover, the perforations may be shaped to serve more than one role. For example, in FIG. 20, the second tray perforations 350 are shaped to house condiments 440 and ventilate the upper compartment at the same time.

The cutouts 242 may also serve a dual purpose. As shown in FIGS. 14 and 18, the cutout 242 can open to the interior of the box thereby providing an additional ledge for the tray 300 to rest on. To that end, the box may comprise multiple cutouts 242 positioned on the side walls to provide additional support, for example when the pizza 420 item resting on the tray 300 is heavier. Of course, in some instances the box may comprise cutouts positioned differently for support as well as air exchange with the exterior of the box.

Figure 19:
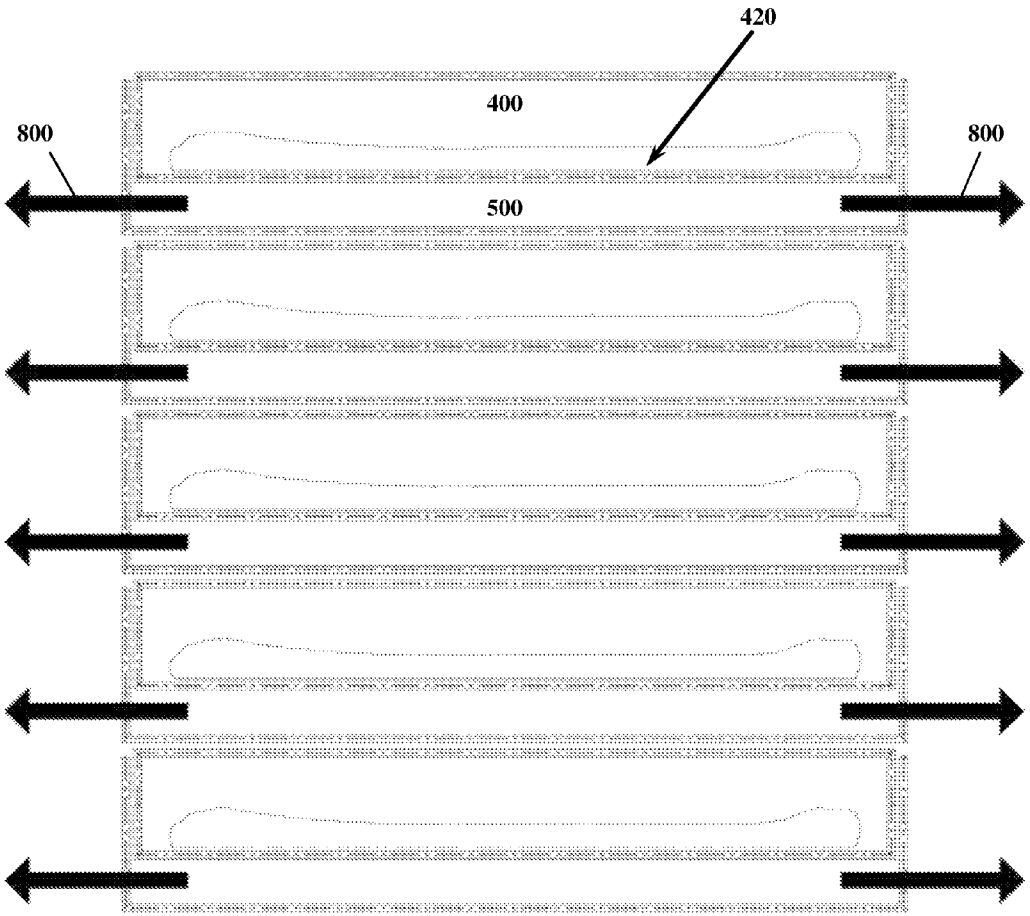
FIG. 19 is a front cross-sectional view of a stack of ventilated boxes.

Ventilating the box through the sides instead of the top and bottom is beneficial in many circumstances, including where multiple pizza boxes are stacked as shown in FIG. 19. Here, the direction of air exchange 800 with the exterior of the box is not impeded by the other boxes. Therefore, regardless of the number of boxes or whether the box is carried out or delivered, the box can maintain the pizza warm without becoming soggy.

In exemplary embodiments, the ventilated box perforations are sized and arranged to sufficiently ventilate the upper compartment such that a pizza located in the upper compartment maintains its crispness during carry out or delivery. This transit time between when the pizza is picked up and when it arrives at the destination where it is consumed, can vary. Typical transit time for delivery or carry out can be, for example between 30-60 minutes, although in some instances it may take longer. As such, a person skilled in the art will be able to determine the sizing and arrangement of the described perforations and cutouts to achieve the desired air flow and heat exchange rate between the interior and exterior of the box based at least on the expected transit time, along with the moisture content and the heat in the box.

In the exemplary embodiment depicted in FIGS. 21-28, the box is constructed from two blanks of material. As shown, the box comprises a tray portion 300 cutout and a separate outer box portion 20 cutout. The outer box portion comprises a top panel 100 and a bottom panel 200. A front wall 260/280 and a rear wall 120 are foldably connected to opposing sides of the bottom panel 200. Sidewalls 220 are also foldably attached to opposing sides of the bottom panel 200.

This exemplary embodiment comprises two attachment locations on the outer box portion. As shown, the bottom panel comprises a front tray attachment receiving portion 126 located adjacent to the front wall 260/280. Additionally, the rear wall 120 comprises a rear tray attachment receiving portion 124. Similar to the previous exemplary embodiment, the front wall here comprises an inner front wall 280 foldably connected to the outer front wall 260. Also the sidewalls 220 comprise front tabs 224 and rear tabs 222. The top panel 100 also comprises a front flap 140.

The tray portion 300 comprises a tray body 308 foldably connected on one side to a first front flap 321 and on the opposite to a tray rear flap 310. Additionally, the first front flap 321 is foldably attached a second front flap 322.

When constructing the box, the second front flap 322 and the rear flap 310 are folded down towards the underside of the tray 300. The degree of appropriate fold may vary based on the relative dimensions and configuration of the tray 300 and outer box 20. In the exemplary embodiments, the tray 300 and outer box 20 portions are dimensioned such that the second front flap 322 and the rear flap 310 can simultaneously reach the front tray attachment receiving portion 126 and rear tray attachment receiving portion 124, respectively.

Here, the front tray attachment portion 322 is adapted to attach to the front tray attachment receiving portion 126 of the bottom panel and the rear tray attachment portion 310 adapted to attach to the rear tray attachment receiving portion 124 of the rear wall, thereby forming a lower compartment defined by the space between the tray 300, the front wall 260/280, the rear wall 120, the bottom panel 200 and the side walls 220. Upon attachment, the tray portion 300 sits in a collapsed position until the top panel 100 is closed or the front wall 260/280 is urged toward the rear wall 120.

Similar to other exemplary embodiments, various techniques may be applied to attach the tray 300 flaps to the bottom pane 200 and rear wall 120. Adhesives or complimentary mechanically interlocking elements are some of many examples. Essentially, any attachment that is able to support the mechanical action of tray 300 between the collapsed and elevated positions is envisioned here.

To complete construction, the side walls 220 are folded up towards each other and the side wall front tabs 224 and rear tabs 222 are folded outward away from the interior of the box. This also causes the tray side flaps 330 to fold upward and create additional stability for the tray.

Additionally, the outer front wall 260 is folded upward until approximately perpendicular to the bottom panel 200 followed by folding on the line between the inner 280 and outer 260 portions. The rear wall is also 120 folded to a position approximately perpendicular to the bottom panel 200. This action pushes on the tray 300 causing it to fold along the line between the tray body 308 and first front flap 321. Accordingly, the tray 300 moves from a collapsed position to an elevated position. A feature of this design is that the tray front flap 321 and rear flap 310 are both folded downward and are in contact with the bottom panel 200 providing yet another source of stability for the weight of the food item on the tray.

Similar to the previous exemplary embodiment, this box is ventilated using perforations on the tray as well as side wall. Again, the front and rear walls may be perforated as well. Specifically, the tray comprises first 340 and second 350 perforations that may be sized and arranged differently from the illustrations. Also, the sidewalls perforations 240 provide a route for air exchange between the lower compartment and the exterior of the box.

As yet another feature, the folding line between the inner 280 and outer 260 front walls is shaped to produce a slit and a tab when folded. Accordingly, the front flap 140 of the top panel 100 may be shaped to fit into the slit thereby further securing the same.

This design allows a user to cut the pizza in the box while on the tray 300 (in collapsed position) instead of outside the box and then move the tray to an elevated position to take advantage of the ventilation to maintain crispness. While it is constructed from two blanks, in some instances the exemplary embodiments may be reproduced using more than two blanks to achieve a similar product.

What is claimed is:

1. A ventilated box for storing and transporting pizza, the box comprising a top panel;

a bottom panel;

a front wall and a rear wall foldably connected to opposing sides of the bottom panel, the rear wall comprising a tray attachment receiving portion and foldably connected to the top panel;

a pair of side walls foldably connected to opposing sides of the bottom panel; and a tray foldably connected to the front wall on one end of said tray and comprising a tray attachment portion at the opposite end;

wherein the tray attachment receiving portion, tray attachment portion or both comprise an adhesive, wherein the box comprises an upper compartment defined at least by a space between the tray, the front wall, the rear wall and the side walls, wherein the tray attachment portion is adapted to attach to the tray attachment receiving portion of the rear wall thereby forming a lower compartment defined by a space between the tray, the front wall, the rear wall, the bottom panel and the side walls, wherein urging the rear wall toward the front wall elevates the tray away from the bottom panel, when the tray attachment portion is adhesively secured to the tray attachment receiving portion, and wherein the tray, and at least one sidewall, rear wall or front wall comprise perforations which ventilate the upper compartment to the exterior of the box.

2. The box of claim 1, wherein the box is configured to urge the rear wall toward the front wall when the top panel is folded over the tray.

3. The box of claim 1, wherein the sidewall perforations are located adjacent to the lower compartment such that the steam emanating from a food item located in the upper compartment exits into the lower compartment and out of the box through said sidewall perforations located adjacent to lower compartment.

4. The box of claim 1, wherein the box is formed from an integral blank of material.

5. The box of claim 1, wherein the front wall comprises an inner wall foldably connected to an outer wall, the inner wall being connected to the tray and the outer wall being connected to the bottom panel.

6. The box of claim 1, wherein the tray comprises a foldable rear flap located opposite a foldable front flap, and wherein the tray front flap is foldably connected to the rear wall and tray rear flap is foldably connected to the front wall.

7. The box of claim 6, wherein the inner and outer front walls are adjoined by a spacer.

8. The box of claim 6, wherein the tray is adapted to move to a collapsed position where the tray, tray front flap, tray rear flap are positioned substantially in the same plane when the tray is connected to the rear wall.

9. The box of claim 8, wherein the tray is adapted to move to an elevated position where the rear flap is folded toward the bottom panel and the front flap is folded away from the bottom panel.

10. A ventilated box for storing and transporting pizza comprising, an outer box portion comprising, a top panel, a front wall and a rear wall foldably connected to opposing sides of the bottom panel, the rear wall comprising a rear tray attachment receiving portion and foldably connected to the top panel, a bottom panel comprising a front tray attachment receiving portion located, adjacent to the front wall, and a pair of sidewalls foldably connected to opposing sides of the bottom panel; and a tray comprising a front attachment portion and a rear attachment portion located on opposites sides of the tray;

wherein the front tray attachment receiving portion, front tray attachment portion or both comprise an adhesive, wherein the rear tray attachment receiving portion, rear tray attachment portion or both comprise an adhesive, wherein the front tray attachment portion is adapted to adhesively secure to the front tray attachment receiving portion of the bottom panel and the rear tray attachment portion adapted to is adhesively secure to the rear tray attachment receiving portion of the rear wall, thereby forming a lower compartment defined by a space between the tray, the front wall, the rear wall, the bottom panel and the side walls, wherein the box comprises an upper compartment defined by a space between the tray, the front wall, the rear wall, and the sidewalls, wherein urging the rear wall toward the front wall elevates the tray away from the bottom panel, when the front tray attachment portion is adhesively secured to the front tray attachment receiving portion and the rear tray attachment portion is adhesively secured to the rear tray attachment receiving portion, and wherein the tray, and at least one sidewall, rear wall or front wall comprise perforations which ventilate the upper compartment to the exterior of the box.

11. The box of claim 10, wherein the outer box portion is an integral blank of material and the tray is an integral blank of material.

12. The box of claim 11, wherein the pizza has a weight and the weight of a pizza on the tray is supported partially by the tray rear flap pressing against the bottom panel and partially by attachment of the tray front flap to the rear wall.

13. The box of claim 10, wherein the tray comprises a foldable front flap and a foldable rear flap located on opposite sides of the tray.

14. The box of claim 10, further wherein the front flap further comprises a first front flap foldably connected to a second front flap, and the second front flap comprises front tray attachment portion.

15. The box of claim 10, wherein folding the top panel over the tray urges the rear wall towards the front wall.

16. The box of claim 10, wherein the front wall comprises an inner wall foldably connected to an outer wall, the inner wall being connected to the tray and the outer wall being connected to the bottom panel.

17. The box of claim 10, wherein the tray comprises a foldable rear flap located opposite a foldable front flap, and the tray front flap is foldably connected to the bottom panel and tray rear flap is foldably connected to the rear wall.

18. The box of claim 10, wherein the tray is adapted to move to a collapsed position where the tray, tray front flap, tray rear flap are positioned substantially in the same plane when the tray is connected to the bottom panel and the rear wall.

19. The box of claim 18, wherein the tray is adapted to move to an elevated position where the tray rear flap and tray front flap are folded toward the bottom.

20. The box of claim 10, wherein the weight of a pizza on the tray is supported partially by the attachment of the tray rear flap pressing into the bottom panel and partially by the tray front flap pressing into the bottom panel.

21. A ventilated box for storing and transporting pizza, the box comprising:

a top panel;

a bottom panel;

a front wall and a rear wall foldably connected to opposing sides of the bottom panel, the rear wall comprising a tray attachment receiving portion and foldably connected to the top panel;

a pair of side walls foldably connected to opposing sides of the bottom panel; and a tray foldably connected to the front wall on one end of said tray and comprising a tray attachment portion at the opposite end, wherein the tray attachment receiving portion, tray attachment portion or both comprise an adhesive; and in a fully folded out configuration of the box:

the top panel, bottom panel and tray are in the same plane;

in a partially folded out configuration of the box:

the tray attachment portion is adhesively secured to the tray attachment portion, to form a lower compartment defined by a space between the tray, the front wall, the rear wall, the bottom panel and the side walls, wherein the lower compartment space has a first volume in said partially folded out configuration; and in a closed configuration of the box:

the top panel is folded over the tray to close the box, where an upper compartment is defined by a space between the tray, the front wall, the rear wall and the side walls;

the tray attachment portion is adhesively secured to the tray attachment receiving portion;

the rear wall is folded toward the front wall thereby elevating the tray away from the bottom panel to form a lower compartment defined by a space between the tray, the front wall, the rear wall, the bottom panel and the side walls;

wherein the lower compartment in the closed configuration has a second volume which is larger than the first volume of the lower compartment in the partially folded out configuration, and wherein the tray, and at least one sidewall, rear wall or front wall comprise perforations which ventilate the upper compartment to the exterior of the box.

* * * * *